US009186558B2

(12) United States Patent
Fitchett et al.

(10) Patent No.: US 9,186,558 B2
(45) Date of Patent: Nov. 17, 2015

(54) GOLF BALL HAVING AN AERODYNAMIC COATING INCLUDING MICRO SURFACE ROUGHNESS

(75) Inventors: Derek A. Fitchett, Beaverton, OR (US); Nicholas Yontz, Portland, OR (US); Johannes Anderl, Vienna (AT)

(73) Assignee: NIKE, Inc., Beaverton, OR (US)

( * ) Notice: Subject to any disclaimer, the term of this patent is extended or adjusted under 35 U.S.C. 154(b) by 556 days.

(21) Appl. No.: 13/484,940

(22) Filed: May 31, 2012

(65) Prior Publication Data

US 2012/0302375 A1 Nov. 29, 2012

Related U.S. Application Data

(63) Continuation-in-part of application No. 13/184,254, filed on Jul. 15, 2011, which is a continuation-in-part of application No. 12/569,955, filed on Sep. 30, 2009, now abandoned.

(51) Int. Cl.

| | |
|---|---|
| ***A63B 37/12*** | (2006.01) |
| ***A63B 37/00*** | (2006.01) |
| ***A63B 45/00*** | (2006.01) |

(52) U.S. Cl.

CPC ..... *A63B 37/12* (2013.01); *A63B 37/0005* (2013.01); *A63B 37/0022* (2013.01); *A63B 37/0075* (2013.01); *A63B 45/00* (2013.01); *A63B 37/0076* (2013.01)

(58) Field of Classification Search

CPC ..... A63B 37/0004; A63B 37/005; A63B 37/0022; A63B 37/14

USPC ..... 473/378, 383

See application file for complete search history.

(56) References Cited

U.S. PATENT DOCUMENTS

| | | | | |
|---|---|---|---|---|
| 3,819,190 | A * | 6/1974 | Nepela et al. | 473/383 |
| 4,266,773 | A * | 5/1981 | Treadwell | 473/383 |
| 4,284,276 | A | 8/1981 | Worst | |
| 4,438,924 | A | 3/1984 | Carr | |
| 4,987,702 | A | 1/1991 | Anschutz | |
| 5,427,378 | A | 6/1995 | Murphy | |
| 5,766,097 | A * | 6/1998 | Horiuchi et al. | 473/365 |
| 5,830,077 | A | 11/1998 | Yavitz | |

(Continued)

FOREIGN PATENT DOCUMENTS

| | | |
|---|---|---|
| CN | 1953790 | 4/2007 |
| EP | 2314359 | 4/2011 |

(Continued)

OTHER PUBLICATIONS

JP Office Action for Application No. 2011-0156290, dated Jun. 19, 2013, 46 pages.

(Continued)

*Primary Examiner* — John E Simms, Jr.

(74) *Attorney, Agent, or Firm* — Banner & Witcoff, Ltd.

(57) ABSTRACT

Golf balls having an exterior surface with a predetermined area which is smaller than the entire surface area of the exterior surface, includes enhanced micro surface roughness, and is in the form of an asymmetrical pattern on the exterior surface of the golf ball. The enhanced micro surface roughness affects the aerodynamic properties of the ball as compared to golf balls having the same set of construction specifications but without enhanced micro surface roughness.

4 Claims, 34 Drawing Sheets

(56) References Cited

U.S. PATENT DOCUMENTS

| | | | | |
|---|---|---|---|---|
| 5,984,806 | A | 11/1999 | Sullivan et al. | |
| 6,193,617 | B1 * | 2/2001 | Mertens | 473/351 |
| 6,315,681 | B1 | 11/2001 | Sullivan | |
| 6,475,106 | B1 | 11/2002 | Green et al. | |
| 6,569,038 | B2 | 5/2003 | Sullivan | |
| 6,596,837 | B2 | 7/2003 | Hogge et al. | |
| 6,729,976 | B2 | 5/2004 | Bissonnette et al. | |
| 6,743,123 | B2 | 6/2004 | Sullivan | |
| 6,821,191 | B2 | 11/2004 | Lim et al. | |
| 6,849,007 | B2 | 2/2005 | Morgan et al. | |
| 6,866,802 | B2 | 3/2005 | Puniello et al. | |
| 6,902,498 | B2 | 6/2005 | Sullivan et al. | |
| 6,908,402 | B2 | 6/2005 | Sullivan et al. | |
| 6,919,395 | B2 | 7/2005 | Rajagopalan et al. | |
| 6,939,249 | B2 | 9/2005 | Sullivan | |
| 6,945,878 | B2 | 9/2005 | Binette et al. | |
| 6,991,563 | B2 | 1/2006 | Sullivan et al. | |
| 7,115,050 | B2 | 10/2006 | Andre et al. | |
| 7,232,384 | B2 | 6/2007 | Sullivan et al. | |
| 7,281,997 | B2 | 10/2007 | Kennedy, III et al. | |
| 7,388,053 | B2 | 6/2008 | Sullivan et al. | |
| 7,534,834 | B2 | 5/2009 | Onoda et al. | |
| 8,275,587 | B2 | 9/2012 | Sato et al. | |
| 2002/0025864 | A1 | 2/2002 | Barfield | |
| 2002/0077195 | A1 * | 6/2002 | Carr et al. | 473/328 |
| 2002/0173384 | A1 | 11/2002 | Hogge | |
| 2003/0114252 | A1 * | 6/2003 | Hayashi et al. | 473/371 |
| 2003/0119608 | A1 | 6/2003 | Hayashi et al. | |
| 2003/0148828 | A1 | 8/2003 | Isogawa | |
| 2004/0015602 | A1 | 1/2004 | Goldhammer et al. | |
| 2004/0052970 | A1 | 3/2004 | Ohira | |
| 2004/0053707 | A1 | 3/2004 | Ohira | |
| 2004/0087389 | A1 | 5/2004 | Kasashima et al. | |
| 2004/0266559 | A1 * | 12/2004 | Asakura | 473/378 |
| 2005/0277488 | A1 * | 12/2005 | Onoda et al. | 473/354 |
| 2006/0030428 | A1 | 2/2006 | Ohira | |
| 2006/0148591 | A1 | 7/2006 | Hebert et al. | |
| 2007/0015602 | A1 | 1/2007 | Watanabe | |
| 2007/0093318 | A1 | 4/2007 | Bartsch et al. | |
| 2007/0213143 | A1 | 9/2007 | Chinn | |
| 2008/0064529 | A1 | 3/2008 | Kennedy, III et al. | |
| 2008/0220907 | A1 | 9/2008 | Aoyama et al. | |
| 2008/0280699 | A1 * | 11/2008 | Jarvholm | 473/378 |
| 2009/0111614 | A1 | 4/2009 | Ohira | |
| 2010/0037914 | A1 | 2/2010 | Miller | |
| 2010/0311521 | A1 | 12/2010 | Ohira | |
| 2011/0077106 | A1 * | 3/2011 | Fitchett | 473/385 |
| 2011/0136590 | A1 | 6/2011 | Kim | |
| 2011/0177885 | A1 | 7/2011 | Ichikawa | |
| 2011/0183777 | A1 | 7/2011 | Oh | |
| 2011/0190077 | A1 * | 8/2011 | Sajima et al. | 473/378 |
| 2013/0104932 | A1 | 5/2013 | Fehsenfeld et al. | |
| 2013/0168896 | A1 | 7/2013 | Tutmark | |

FOREIGN PATENT DOCUMENTS

| | | | | |
|---|---|---|---|---|
| JP | 07-194733 | | 8/1995 | |
| JP | 2002-536136 | A | 10/2002 | |
| JP | 2002-369896 | * | 12/2002 | A63B 37/00 |
| JP | 2002369896 | A | 12/2002 | |
| JP | 2002543945 | | 12/2002 | |
| JP | 2004-107485 | A | 4/2004 | |
| JP | 2004-130111 | A | 4/2004 | |
| JP | 2004-147836 | | 5/2004 | |
| JP | 2004-147836 | A | 5/2004 | |
| JP | 2005-027774 | | 2/2005 | |
| JP | 2006-051357 | A | 2/2006 | |
| JP | 2006-075210 | A | 3/2006 | |
| JP | 08-308958 | A | 11/2006 | |
| JP | 2008-161375 | A | 7/2008 | |
| JP | 2009-106720 | | 5/2009 | |
| WO | 9843711 | | 10/1998 | |
| WO | 0069526 | | 11/2000 | |
| WO | 0152944 | | 7/2001 | |
| WO | 2008137973 | | 11/2008 | |

OTHER PUBLICATIONS

Elmar Achenbach (1974), "The Effects of Surface Roughness and Tunnel Blockage on the Flow Past Spheres," J. Fluid Mechanics, vol. 65, part 1, pp. 113-125.

Sajima, T., Yamaguchi, T., Yabu, M., and Tsunoda, M. (2006), The Aerodynamic Influence of Dimple Design on Flying Golf Ball, in Springer (ed.), Engineering of Sport 6, p. 143.

Jin Choi, Woo-Pyung Jeon, and Haecheon Choi (2006), "Mechanism of Drag Reduction by Dimples on a Sphere," by Physics of Fluids 18, pp. 1-4.

Kimura, T. and Tsutahara, M. (1990), "Fluid Dynamic Effects of Grooves on Circular Cylinder Surface," AIAA Journal, vol. 29, No. 12, pp. 2062-2068.

Mehta, R.D. and Pallis, J.M. (2001), "Sports Ball Aerodynamics: Effects of Velocity, Spin, and Surface Roughness," Materials and Science in Sports, TMS, p. 185.

Smits, A.J., and Smith, D.R. (1994), "A New Aerodynamic Model of a Golf Ball in Flight," Science and Golf II: Proceedings of the World Scientific Congress of Golf, London: E & FN Spon.

Ting, L.L. (2003), "Effects of Dimple Size and Depth on Golf Ball Aerodynamic Performance," Proceedings of FEDSM'03 4th ASME_JSME Joint Fluids Engineering Conference, pp. 811-817.

Smith, C., Beratlis, N., Balaras, E., Squires, K., and Tsunoda, M. (2008), "Direct Numerical Simulation of the Flow Around a Golf Ball," Science and Golf V, Proceedings of the World Scientific Congress of Golf, Mesa: Energy in Motion Inc., p. 421.

Quintavalla, S. ((2002), "Golf Ball Performance Evaluation Using High-Volume Indoor Aerodynamic Testing," ITEA Journal, January, pp. 21-25.

Limited R&A Rules (2005), Rule 5—The Golf Ball, in A Guide to the Rules of Clubs and Balls, 2nd Edition, pp. 41-42.

European Search Report issued in EPO Patent Application No. 10172697.4 on Mar. 11, 2011, 6 pages.

Questioning for corresponding Japanese Patent Application 2010-180877 dated Sep. 26, 2011, 8 pages.

Notification from Japanese Patent Office for corresponding Japanese Patent Application No. 2011-156290 dated Mar. 26, 2012, 1 pages.

Third-Party Submission of Information for corresponding Japanese Patent Application No. 2011-156290 dated Mar. 15, 2012, 13 pages.

Non-Final Office Action for U.S. Appl. No. 12/569,955, mailed Jun. 6, 2012, 27 pages.

Office Action dated Aug. 31, 2012, for Chinese Application No. 201010295506.1, 8 pages.

English translation of Office Action dated Aug. 31, 2012, for Chinese Application No. 201010295506.1, 13 pages.

International Search Report and Written Opinion for PCT/US2012/046904 dated Jan. 28, 2013, 16 pages.

International Search Report for PCT/US2012/046750, dated Oct. 5, 2012, 4 pages.

International Search Report for PCT/US2012/046648, dated Oct. 5, 2012, 5 pages.

Machine English Translation of previously submitted JP2002-369896, translation dated Nov. 24, 2014.

Machine English Translation of previously submitted JP2004-147836, translation dated Nov. 24, 2014.

Apr. 23, 2015—(JP) Office Action—JP2014-521675.

Apr. 23, 2015—(JP) Office Action—App JP2014-521667.

Apr. 23, 2015—(JP) Office Action—App JP2014-521692.

* cited by examiner

Ra = Average (1, 4, 6, 8, 5, 2, 1, 4, 1, 2, 1, 4, 7, 4, 1, 2, 5, 8, 5, 2, 1, 4, 1, 1)

Ra = 3.33

Driver Shot Simulation Data: Differences in Total Carry and Roll in Yards in Comparison to Control for Roughened Balls in Pole and Seam Position with Different Launch Conditions

| | 258ft/s, 11deg, 33.3r/s | | | 242ft/s, 11.3deg, 44.7r/s | | | 258ft/s, 9.7deg, 46r/s | | |
|---|---|---|---|---|---|---|---|---|---|
| Ball | Pole | Seam | Overall | Pole | Seam | Overall | Pole | Seam | Overall |
| R | 0.3 | 0.5 | 0.4 | 0.7 | 0.4 | 0.5 | 0.7 | 0.5 | 0.6 |
| S | 0.1 | 0.6 | 0.8 | 0.6 | 0.4 | 0.5 | 0.6 | 0.6 | 0.6 |
| Q | -0.4 | -0.6 | -0.5 | 0.6 | -0.3 | 0.1 | 0.7 | -0.1 | 0.3 |
| T | -3.6 | -2.1 | -2.9 | -3.9 | -2 | -3 | -3.5 | -1.6 | -2.5 |
| U | 1.4 | 1.4 | 1.4 | 0.8 | 1 | 0.9 | -0.5 | 2 | 0.7 |

FIG. 20A

Driver Shot Simulation Data for Balls in Pole Position with Different Launch Conditions (▣,△)

| | | 258 ft/s, 9.7 deg, 46 r/s (▣) | | | 242 ft/s, 11.3 deg, 44.7 r/s (△) | | |
|---|---|---|---|---|---|---|---|
| Ball | MSR (μm) $Ra_{0.25mm}$ | $C_L/C_D$ pre-apex | $C_L/C_D$ post-apex | $C_L/C_D$ Overall ave. | $C_L/C_D$ pre-apex | $C_L/C_D$ post-apex | $C_L/C_D$ Overall ave. |
| Control | 0.6 | 0.854 | 0.836 | 0.846 | 0.858 | 0.833 | 0.846 |
| V | 1.2 | 0.854 | 0.849 | 0.852 | 0.858 | 0.846 | 0.852 |
| W | 1.9 | 0.834 | 0.864 | 0.848 | 0.838 | 0.862 | 0.849 |
| X | 1.9 | 0.833 | 0.869 | 0.849 | 0.837 | 0.867 | 0.851 |
| Y | 2.3 | 0.773 | 0.882 | 0.825 | 0.780 | 0.879 | 0.827 |
| Z | 2.2 | 0.809 | 0.881 | 0.843 | 0.813 | 0.879 | 0.845 |
| Max +% Difference from Control | Y: +383% | V: 0% | Y: +5.5% | V: +0.7% | V: 0% | Y, Z: +5.5% | V: +0.7% |
| Max -% Difference from Control | n/a | Y: -9.5% | n/a | Y: -2.5% | Y: -9.1% | n/a | Y: -2.2% |

FIG. 21A

Driver Shot Simulation Data for Balls in Pole Position

| Ball | MSR (μm) $Ra_{0.25mm}$ | Carry (yds) | Roll (yds) | Total (yds) | Apex (yds) | Angle (deg) | Time (s) |
|---|---|---|---|---|---|---|---|
| Control | 0.6 | 276 | 15.1 | 291.1 | 38.5 | 42 | 7.23 |
| V | 1.2 | 274.7 | 14.8 | 289.5 | 38.8 | 42.3 | 7.26 |
| W | 1.9 | 274.9 | 15.9 | 290.8 | 36.8 | 41 | 7.16 |
| X | 1.9 | 272.6 | 15.5 | 288.1 | 36.9 | 41.3 | 7.18 |
| Y | 2.3 | 267.5 | 18.1 | 285.6 | 32.8 | 38.1 | 6.83 |
| Z | 2.2 | 271.6 | 16.7 | 288.3 | 34.8 | 39.7 | 7.04 |
| Max +% Difference from Control | Y: +383% | n/a | Y: +19.9% | n/a | V: +0.1% | V: +0.7% | V: +0.4% |
| Max -% Difference from Control | n/a | Y: -3.1% | V: -2.0% | Y: -1.9% | Y: -14.8% | Y: -9.3% | Y: -5.5% |

FIG. 21G

Driver Shot Simulation Data for Balls in Seam Position

| Ball | MSR (μm) $Ra_{0.25mm}$ | Carry (yds) | Roll (yds) | Total (yds) | Apex (yds) | Angle (deg) | Time (s) |
|---|---|---|---|---|---|---|---|
| Control | 0.6 | 277.4 | 15.8 | 293.2 | 36.7 | 41 | 7.25 |
| V | 1.2 | 278.1 | 16.6 | 294.7 | 35.7 | 40.2 | 7.19 |
| W | 1.9 | 275.5 | 17 | 292.5 | 34.8 | 39.4 | 7.10 |
| X | 1.9 | 273.4 | 16.9 | 290.3 | 34.8 | 39.7 | 7.07 |
| Y | 2.3 | 266.4 | 19.3 | 285.7 | 31.4 | 36.6 | 6.68 |
| Z | 2.2 | 271.5 | 18.1 | 289.6 | 33.1 | 38 | 6.92 |
| Max +% Difference from Control | Y: +383% | V: +0.3% | Y: +22.2% | V: +0.5% | n/a | n/a | n/a |
| Max -% Difference from Control | n/a | Y: -4.0% | n/a | Y: -2.6% | Y: -14.4% | Y: -10.7% | Y: -4.6% |

FIG. 21H

GOLF BALL HAVING AN AERODYNAMIC COATING INCLUDING MICRO SURFACE ROUGHNESS

RELATED APPLICATION DATA

This application is a continuation-in-part of U.S. patent application Ser. No. 13/184,254 filed Jul. 15, 2011 in the name of Derek Fitchett and Johannes Anderl, which is a continuation-in-part of U.S. patent application Ser. No. 12/569,955 filed Sep. 30, 2009 in the name of Derek Fitchett. These parent applications are entirely incorporated herein by reference.

FIELD OF THE INVENTION

The present invention relates generally to golf balls. Particular example aspects of this invention relate to golf balls having a coating with micro surface roughness that improves the aerodynamic performance of the ball.

BACKGROUND

Golf is enjoyed by a wide variety of players—players of different genders and dramatically different ages and/or skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with the increased availability of golf programming on television (e.g., golf tournaments, golf news, golf history, and/or other golf programming) and the rise of well-known golf superstars, at least in part, have increased golf's popularity in recent years.

Golfers at all skill levels seek to improve their performance, lower their golf scores, and reach that next performance "level." Manufacturers of all types of golf equipment have responded to these demands, and in recent years, the industry has witnessed dramatic changes and improvements in golf equipment. For example, a wide range of different golf ball models now are available, with balls designed to complement specific swing speeds and/or other player characteristics or preferences, e.g., with some balls designed to fly farther and/or straighter; some designed to provide higher or flatter trajectories; some designed to provide more spin, control, and/or feel (particularly around the greens); some designed for faster or slower swing speeds; etc. A host of swing and/or teaching aids also are available on the market that promise to help lower one's golf scores.

Being the sole instrument that sets a golf ball in motion during play, golf clubs also have been the subject of much technological research and advancement in recent years. For example, the market has seen dramatic changes and improvements in putter designs, golf club head designs, shafts, and grips in recent years. Additionally, other technological advancements have been made in an effort to better match the various elements and/or characteristics of the golf club and characteristics of a golf ball to a particular user's swing features or characteristics (e.g., club fitting technology, ball launch angle measurement technology, ball spin rate measurement technology, ball fitting technology, etc.).

Modern golf balls generally comprise either a one-piece construction or multiple layers including an outer cover surrounding a core. Typically, one or more layers of paint and/or other coatings are applied to the outer surface of the golf ball. For example, in one typical design, the outer surface of the golf ball is first painted with at least one clear or pigmented basecoat primer followed by at least one application of a clear coating or topcoat. The clear coating may serve a variety of functions, such as protecting the cover material (e.g., improving abrasion resistance or durability), improving aerodynamics of ball flight, preventing yellowing, and/or improving aesthetics of the ball.

One common coating utilizes a solvent borne two-component polyurethane, which is applied to the exterior of a golf ball. The coating may be applied, for example, by using compressed air or other gas to deliver and spray the coating materials. The balls and spray nozzles may be rotated or otherwise articulated with respect to one another to provide an even coating layer over the entire ball surface.

Dimples were added to golf balls to improve the aerodynamics as compared with smooth balls. Variations of the dimples have been introduced over the years relating to their size, shape, depth, and pattern. Other concepts have included the inclusion of small dimples or other structures within dimples to provide different aerodynamic performance. Such small dimples or other structures, however, often fill up during application of a paint or top coat to the outer surface of the ball, thus destroying or substantially reducing the intended dimple-in-dimple aerodynamic effect of the balls.

While the industry has witnessed dramatic changes and improvements to golf equipment in recent years, some players continue to look for increased distance on their golf shots, particularly on their drives or long iron shots, and/or improved spin or control of their shots, particularly around the greens and/or at initial launch. Accordingly, there is room in the art for further advances in golf technology.

SUMMARY

The following presents a general summary of aspects of the disclosure in order to provide a basic understanding of the disclosure and various aspects of this invention. This summary is not intended to limit the scope of the invention in any way, but it simply provides a general overview and context for the more detailed description that follows.

Aspects of this disclosure are directed to imparting enhanced micro surface roughness on a golf ball by roughening the exterior surface of the ball through abrasion to include deviations in the exterior surface of the ball in a sufficient amount such that the micro surface roughness of the ball is increased. Methods of abrading include rubbing the ball against an abrasive material, rolling or tumbling the ball against an abrasive material, and/or blasting the ball with abrasive material. Abrasive material can include, for example, a loose aggregate of abrasive particulate (e.g. sand, crushed minerals, etc.), a bonded abrasive, a coated abrasive (e.g. sand paper), a pumice, a sharp surface, and/or a scored surface.

Aspects of this disclosure are directed to selectively increasing micro surface roughness of predetermined areas of the ball. The predetermined area can be less than a surface area of the entire exterior surface area of the ball. Example predetermined areas can include an area covering at least one of two opposite poles of the golf ball, an area covering at least a portion of a seam of the golf ball, an area covering at least a portion of the lands between dimples of the golf ball, and an area covering at least a portion of one or more of the dimples. The predetermined area can be in the form of a symmetrical or asymmetrical pattern on the exterior surface of the golf ball.

Aspects of this disclosure are directed to a stencil used to cover the exterior surface of the golf ball during selective micro surface roughening. The stencil can leave exposed the predetermined area for selective roughening and cover the remaining area to protect the remaining area from being roughened or being subject to further roughening.

Aspects of this disclosure are directed to optimizing micro surface roughness so that a ball exhibits a particular enhanced aerodynamic property in accordance with a peak condition for such property as compared to comparative balls having different aspects of micro surface roughness. Aspects of micro surface roughness can be varied in order to determine an optimized micro surface roughness so that the ball exhibits the enhanced aerodynamic property or enhanced aerodynamic property in accordance with a peak condition for such property as compared to comparative balls having different aspects of micro surface roughness.

As used herein, balls will be considered to have the "same ball construction" if they are made to the same construction specifications with the exception of the roughening material incorporated into the structure (e.g., same core size and materials, same intermediate layer(s) size(s) and material(s), same cover size and material, same dimple patters, etc.) or use of a processes that impart increased micro surface roughness to the exterior surface of a ball. Also, as used herein, two dimples will be considered to be of different dimple "types" if they differ from one another in at least one of dimple perimeter shape or dimple profile (cross sectional) shape, including but not limited to different dimple depths, different dimple diameters, or different dimple radii. Two dimples will be considered to be of the "same type" if the CAD or other "blueprint" data or specifications for making the mold cavity for forming the dimples indicates that the dimples are intended to have the same size and shape (post mold treatments, such as coating or painting, may slightly alter the dimensions from dimple to dimple within a given dimple type, and these post-molding changes do not convert dimples of the same "type" to dimples of different "types").

Other aspects of this invention are directed to methods for making golf balls including particles to increase micro surface roughness of the ball, e.g., by applying a coating comprising a resin and particles to a surface of a golf ball, by incorporating roughness increasing particles into the cover member, by incorporating roughness into the exterior surface of the ball by abrasion, etc.

BRIEF DESCRIPTION OF THE DRAWINGS

A more complete understanding of the present invention and certain advantages thereof may be acquired by referring to the following detailed description in consideration with the accompanying drawings, in which:

FIG. 20A is a table including driver shot simulation data showing differences in total carry and roll in yards in comparison to a control ball for roughened balls in accordance with examples of this disclosure in pole and seam position with different launch conditions.

FIG. 21A is table including driver shot simulation data for balls in pole position with different launch conditions for a smooth control ball and roughened balls in accordance with examples of this disclosure.

FIG. 21G and FIG. 21H are tables including driver shot simulation data for a smooth control ball and roughened with different launch conditions in pole and seam position, respectively.

The reader is advised that the various parts shown in these drawings are not necessarily drawn to scale.

DETAILED DESCRIPTION

In the following description of various example structures, reference is made to the accompanying drawings, which form a part hereof, and in which are shown by way of illustration various example golf ball structures. It is to be understood that other specific arrangements of parts and structures may be utilized and structural and functional modifications may be made without departing from the scope of the present invention. As some more specific examples, aspects of this invention may be practiced on balls having any desired construction, any number of pieces, any specific dimple design, and/or any desired dimple pattern.

General Description of Golf Balls and Manufacturing Systems and Methods

A variety of golf ball constructions have been designed to provide particular playing characteristics. These characteristics generally include control of the initial velocity and spin of the golf ball, which can be optimized for various types of players. For instance, certain players prefer or need a ball that has a high spin rate in order to optimize launch angle and/or control and stop the golf ball around the greens. Other players prefer or require a ball that has a low spin rate and high resiliency to maximize distance and/or prevent excessive lift at initial launch.

The carry distance and/or "feel" of some conventional two-piece solid balls has been improved by altering the typical single layer core and single cover layer construction to provide a multi-layer ball, e.g., a dual cover layer, a dual core layer, and/or a ball having one or more intermediate mantle layers disposed between the cover and the core. Three-piece and four-piece solid balls (and even five-piece balls) are now commonly found and are commercially available. Aspects of this disclosure may be applied to all types of ball constructions, including wound, solid, and/or multi-layer ball constructions.

Figure 1:
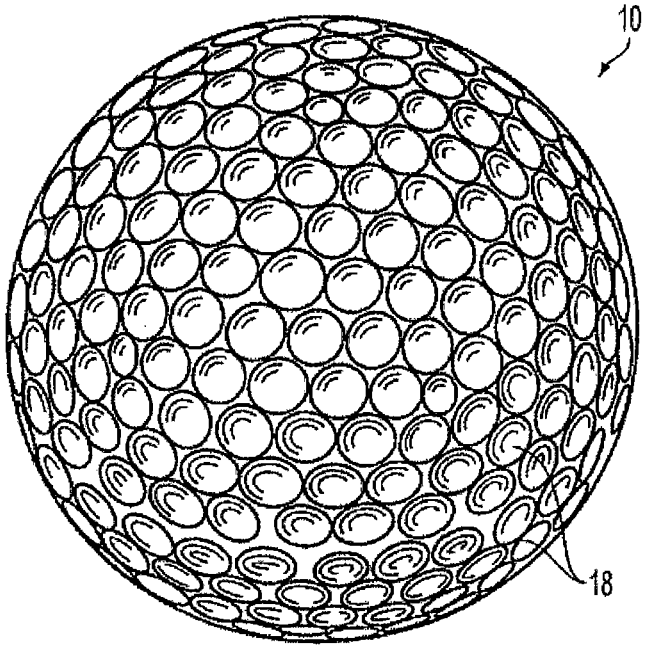
FIG. 1 schematically illustrates a golf ball having dimples.
Figure 2:
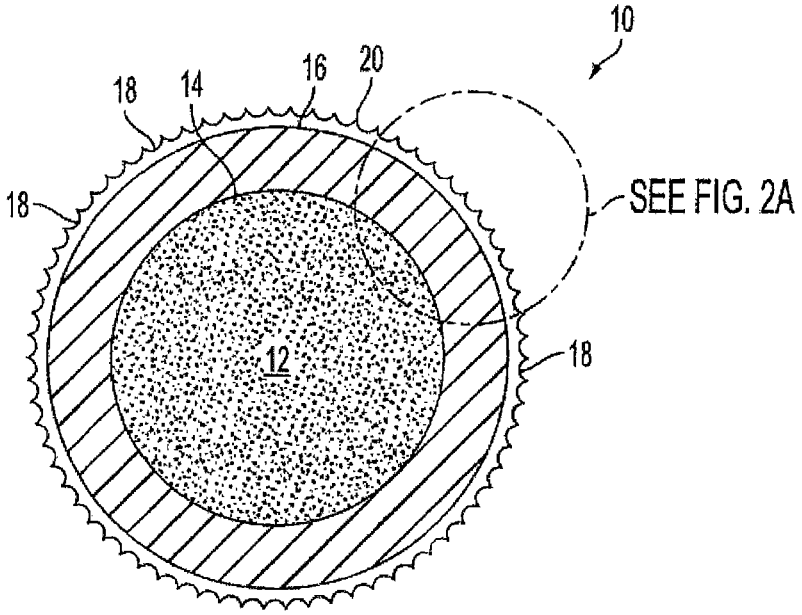
FIGS. 2 and 2A schematically illustrate a cross-sectional view of a golf ball in accordance with FIG. 1 having a coating thereon.
Figure 2A:
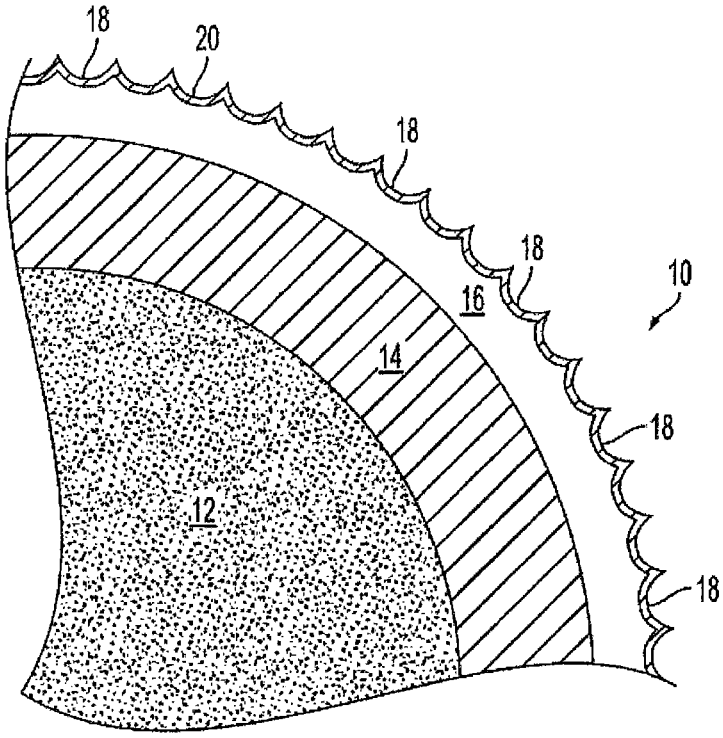

FIG. 1 shows an example of a golf ball 10 that includes a plurality of dimples 18 formed on its outer surface. FIGS. 2 and 2A illustrate one example golf ball 10 in accordance with this disclosure. As shown, this example golf ball has a core 12, an intermediate layer 14, a cover 16 having a plurality of dimples 18 formed therein, and a topcoat 20 applied over the exterior surface of the cover 16 of the ball 10. The golf ball 10 alternatively may be only one piece such that the core 12 represents the entirety of the golf ball 10 structure (optionally with an overlying coating layer 20), and the plurality of dimples 18 are formed on the core 12. The ball 10 also may have any other desired construction (e.g., two-piece solid construction, four-piece solid construction, a wound construction, etc.). The thickness of the topcoat 20 typically is significantly less than that of the cover 16 or the intermediate layer 14, and by way of example may range from about 5 to about 25 μm. The topcoat 20 preferably will have a minimal effect on the depth and volume of the dimples 18. Golf balls 10 according to this disclosure may include one or more pieces for the core 12 (e.g., also called an "inner core," an "outer core," etc.), one or more intermediate layers 14 (e.g., also called "mantle layers" or "barrier layers," etc.), and one or more cover layers 18 (e.g., also called an "inner cover," an "outer cover," etc.).

The golf ball 10 and the various components thereof may be made from any desired materials without departing from this disclosure, including, for example, materials that are conventionally known and used in the golf ball art. As some more specific examples, the cover 16 of the golf ball 10 may be made of any number of materials such as ionomeric, thermoplastic, elastomeric, urethane, TPU, balata (natural or synthetic), polybutadiene materials, or combinations thereof. Micro surface roughness features as described in more detail below may be incorporated into the cover layer 16, in accordance with at least some examples of this disclosure. An optional primer or basecoat may be applied to the exterior surface of the cover 16 of the golf ball 10 prior to application of the coating layer 20. As some more specific examples, the cover layer 16 may be formed of SURLYN® based ionomer resins, thermoplastic polyurethane materials, and thermoset urethane materials, as are conventionally known and used in the art.

A variety of coating materials may be used to form a coating 20 over the golf ball 10, non-limiting examples of which include thermoplastics, thermoplastic elastomers (such as polyurethanes, polyesters, acrylics, low acid thermoplastic ionomers, e.g., containing up to about 15% acid, and UV curable systems), including coating layer materials as are conventionally known or used in the art. The coating layer 20 may constitute a paint layer, a clear coat layer, or other desired material. The thickness of the coating layer 20 will typically range from of about 5 to about 25 μm, and in some examples from about 10 to about 15 μm. The coating layer 20 may include additives, if desired, such as flow additives, mar/slip additives, adhesion promoters, thickeners, gloss reducers, flexibilizers, cross-linking additives, isocyanates or other agents for toughening or creating scratch resistance, optical brighteners, UV absorbers, and the like. The amount of such additives usually ranges from 0 to about 5 wt %, often from 0 to about 1.5 wt %. Also, micro surface roughness features as described in more detail below may be incorporated into the coating layer 20, in accordance with at least some examples of this disclosure.

Example Manufacturing Process

Golf balls in accordance with this disclosure may be produced in any desired manner without departing from this disclosure, including in generally conventional manners as are known and used in the art (with the exception of the additional feature of incorporating micro surface roughness into the ball construction, as will be explained in more detail below). Some example methods are described in more detail below.

As an initial step in one example golf ball manufacturing process, a golf ball central core is made, e.g., by a molding operation, such as compression molding, hot press molding, injection molding, or other procedures as are known and used in the art. Such cores may be made of rubber materials, elastomeric resin materials (such as highly neutralized acid polymer compositions including HPF resins (e.g., HPF1000, HPF2000, HPF AD1027, HPF AD1035, HPF AD1040 and mixtures thereof, all produced by E. I. DuPont de Nemours and Company), and the like. The cores may have any desired physical properties (e.g., COR, density, sizes, diameters, hardnesses, etc.) and/or additives, including properties and additives that are conventionally known and used in the golf ball art.

If desired, one or more intermediate layers 14 may be formed over the core 12 in golf ball constructions in accordance with at least some examples of this disclosure. Such intermediate layers 14 may be formed by molding or lamination procedures, such as injection molding. The intermediate layers 14, when present, may be made from any desired material including materials that are conventionally known and used in the art, such as ionomer resins (e.g., SURLYN®'s, as described above), polyurethanes, TPUs, rubbers, and the like. The intermediate layers 14 may have any desired physical properties (e.g., COR, density, thicknesses, hardnesses, etc.) and/or additives, including properties and additives that are conventionally known and used in the art.

The next step in this example golf ball production process involves forming a cover layer 16 around the golf ball interior (e.g., the core 12 and any present intermediate layers 14). The cover material 16 may be an ionomeric resin (e.g., a SURLYN® material), a thermoplastic polyurethane material, a thermosetting polyurethane material, a rubber material, or the like. The core 12, including the center and any present intermediate layers 14, may be supported within a pair of cover mold-halves by a plurality of retractable pins. The retractable pins may be actuated by conventional means known to those of ordinary skill in the art. After the mold halves are closed together with the pins supporting the ball interior, the cover material is injected into the mold in a liquid or flowable state through a plurality of injection ports or gates, such as edge gates or sub-gates. The mold halves will include structures that result in formation of dimples 18 in the cover layer 16. In some example structures in accordance with this disclosure, the cover material may form a base material for carrying the micro surface roughness increasing materials (e.g., the silica or other roughening particles). The micro surface roughness increasing material may be included in all areas of the cover material or in separated and discrete targeted areas of the cover material, as will be described in more detail below.

The retractable pins may be retracted after a predetermined amount of cover material has been injected into the mold halves to substantially surround the ball interior. The flowable cover material is allowed to flow and substantially fill the cavity between the ball interior and the mold halves, while maintaining concentricity between the ball interior and the mold halves. The cover material is then allowed to solidify around the ball interior, and the golf balls are ejected from the mold halves. As another option, the golf ball cover 16 may be formed by casting procedures, e.g., as conventionally known and used in this art, although the micro surface roughness increasing material may be incorporated into the material used for the casting process, if desired.

As a next step, if desired, a finish material, such as paint and/or one or more other coating layer(s) 20, may be applied to the golf ball cover 16 surface. As another finishing step (which may take place before or after one of the coating steps as described above), printing may be applied to a golf ball. Any desired type of printing technique may be used without departing from this disclosure, including printing techniques such as pad printing and ink jet printing and/or other printing techniques that are conventionally known and used in the art. The finish materials (e.g., coating layer 20) may form a base material for carrying the micro surface roughness increasing material, as will be described in more detail below.

Detailed Description of Example Golf Balls and Methods According to Aspects of the Invention The term "golf ball body" as used herein means a golf ball before applying the top coat (e.g., a ball structure including a core, one or more intermediate layers, and a cover layer with dimples). In terms of the discussion below, the term "coating" often will be used to identify the top coat or last layer applied to the golf ball, but, as also described below, if desired, another coating may be applied over the roughened coating material or roughened cover layer, if desired, provided that an overall micro surface roughened outer surface is still provided. Often the terms "paint" or "painting" may be used synonymously with a "coating" or "coating" process without departing from this invention.

The term "enhanced micro surface roughness" as used herein means increased micro surface roughness created by the use of surface roughening particles or processes that impart increased micro surface roughness to the exterior surface of a ball.

As described above, the term "construction specifications" as applied to a golf ball means all of the constructions specifications involving the construction of a ball other than materials or processes used to impart enhanced micro surface roughness to a ball. Balls with the same construction specifications will have the same core size and materials, same intermediate layer(s) size(s) and material(s), same cover size and material, same dimple patterns (positions and sizes), etc. Balls having the same construction specifications can be substantially identical or differ only in having materials and/or being subject to processes used to impart enhanced micro surface roughness to a ball. For example, a first and second ball can have the same construction specifications even though the first ball has no surface roughening particles in its coating and the second ball includes surface roughening particles in its coating. Similarly, for example, a first and second ball can have the same construction specifications even though the first ball has a first amount of surface roughening particles in its coating which results in a first degree of micro surface roughness for the first ball and the second ball has a second amount of surface roughening particles in its coating which results in a second degree of micro surface roughness for the second ball. For example, in the above examples, the micro surface roughness of the second ball can be larger than the micro surface roughness of the first ball and vice versa.

The term "smooth ball" as used herein means a ball that does not have surface roughening particles in sufficient amount to impart increased micro surface roughness to the exterior surface of the ball and/or was not subject to processes to impart increased micro surface roughness to the exterior surface of a ball.

Some aspects of this invention relate to golf balls having a top coat or other coating over the cover layer, wherein this coating comprises a resin having particles contained therein or applied thereon. The particles provide a golf ball having a somewhat roughened surface (e.g., micro-roughened), as will be described in more detail below.

Figure 3:
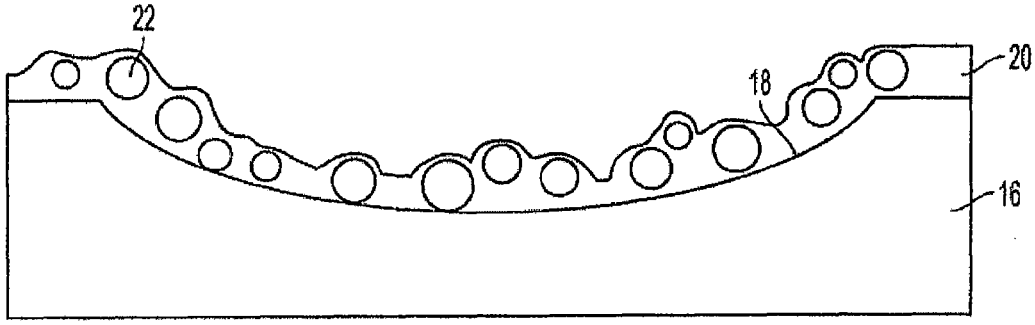
FIG. 3 schematically illustrates a cross-sectional view of a portion of a golf ball having a cover layer and coating in accordance with FIG. 1 having particles contained within a resin.

If the resin contains the particles, after the resin is applied to the golf ball body to form the coating, at least some of the particles may protrude beyond an average thickness of the resin. In some instances, the average size of the particles may be greater than the average thickness of the resin. As shown in FIG. 3, generally the particles 22 protrude from the surface such that a thin portion of the resin 20 still covers the particles. The surface of the ball will therefore be roughened somewhat, as shown in FIG. 3. The coating 20 thickness and surface roughness shown in FIG. 3 is exaggerated to help better illustrate features of this aspect of the invention.

Figure 4:
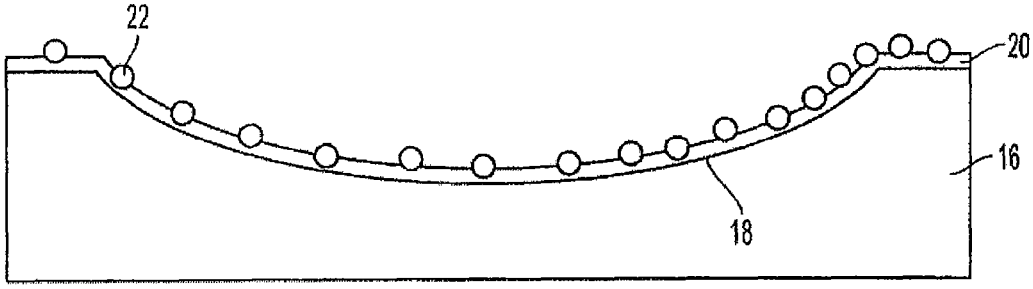
FIG. 4 schematically illustrates a cross-sectional view of a portion of a golf ball having a cover layer and coating in accordance with FIG. 1 having particles applied onto the surface of a resin.

If the resin itself does not contain the particles necessary to provide the roughened surface when it is applied to the golf ball cover 18, after the resin is applied, and prior to drying, particles may be applied to the wet resin. The particles may adhere to and/or become at least partially embedded into the resin, but still extend from the surface of the resin to provide a somewhat roughened surface. As shown in FIG. 4, in this example structure and method, particles 22 are applied to the surface of resin 20. Again, the sizes shown in FIG. 4 are exaggerated to help better illustrate features of this aspect of the invention.

If desired, the features of FIGS. 3 and 4 may be combined into a single ball construction. More specifically, if desired, after the coating process of FIG. 3, additional particles may be adhered to the coating 20 in a process like that shown and described above in conjunction with FIG. 4. The additional step of post coating particle adherence (e.g., like that of FIG. 4) may be selectively applied to certain areas of the ball (e.g., areas where lower than desired roughness is observed) or may be applied to specific predetermined areas of the ball (e.g., at the poles, at the seam, at areas covered or "shadowed" by a holding device during an initial coating process, etc.). Additionally or alternatively, if desired, as noted above, roughening particles 22 may be included in the cover layer 16, in at least some examples of this invention. In such arrangements and methods, the coating 20 should not be applied so thick as to completely smooth out the areas between particles 22 in the cover 16 (i.e., so that sufficient micro surface roughness continues to exist in the final product).

The particles 22 allow for fine tuning of and/or improvement to the aerodynamic performance of golf balls in flight, e.g., to enable longer flights of the golf ball, alter lift, etc. The particles cause the finish of the coating to be rougher and on a micro-scale act as small dimples, which is believed to increase the turbulence in the air flow around the ball and shift flow separation to the back of the golf ball, thereby reducing pressure drag. Also, if desired, the durability of the golf ball may be improved both in cut resistance and abrasion resistance, e.g., depending on the properties of and/or materials used in the coating 20.

Given the general description of various example aspects of the invention provided above, more detailed descriptions of various specific examples of golf ball structures according to the invention are provided below.

The following discussion and accompanying figures describe various example golf balls in accordance with aspects of the present invention. When the same reference number appears in more than one drawing, that reference number is used consistently in this specification and the drawings to refer to the same or similar parts throughout.

As described above, FIG. 3 and FIG. 4 illustrate aspects of the invention related to golf balls having a top coat or other coating comprising resin and particles contained within the resin or applied and/or embedded thereon, respectively.

The particles may be of any shape and may be regular, irregular, uniform, non-uniform, or mixtures thereof. The particles may be any polygon or other geometric shape, including regular shapes, such as spheres or cubes. The spheres may have a round cross-section or may be flattened to provide an elongated or oval cross-section. The cubes may be of square or rectangular cross-section. Irregular shapes may be defined by an irregular surface, an irregular perimeter, protrusions, or extensions. The particles may be rounded, elongated, smooth, rough, or have edges. Combinations of different shapes of particles may be used. Crystalline or regular particles, such as tetrapods, may also be used.

Particles may be made from any material known in the art, such as organic or inorganic, plastics, composite materials, ceramics, and metals. Suitable particles include, but are not limited to, amorphous particles, such as silicas, and crystalline particles, such as metal oxides, e.g., zinc oxide, iron oxides, or titanium oxide. As additional examples, particles may comprise fumed silica, amorphous silica, colloidal silica, alumina, colloidal alumina, titanium oxide, cesium oxide, yttrium oxide, colloidal yttria, zirconia, colloidal zirconia, polyethylene terephthalate, polybutylene terephthalate, polyethylene naphthalate, vinyl esters, epoxy materials, phenolics, aminoplasts, polyurethanes and composite particles of silicon carbide or aluminum nitride coated with silica or carbonate.

The particles may be selected to provide a desired level of micro surface roughness to the golf ball to achieve the desired aerodynamic qualities of the golf ball, as well as to optionally improve abrasion resistance. The particles may be of any suitable hardness and durability. Softer particles tend to affect spin, for example.

The average size of the particles may depend on various factors, such as the material selected for the particles. Generally, the particle sizes will range from 400 nm to 40 microns, and in some example constructions, from 5 to 20 microns. In one particular example, the particle sizes range from 8 to 12 microns. The particles may be approximately the same size or may be different sizes, optionally within the defined ranges. If the particles are applied to the surface of the resin (e.g., as in FIG. 4), they would generally be smaller than if they were contained within the coating (e.g., as in FIG. 3).

Any suitable resin may be used including thermoplastics, thermoplastic elastomers such as polyurethanes, polyesters, acrylics, low acid thermoplastic ionomers, e.g., containing up to about 15% acid, and UV curable systems. Specific examples include AKZO NOBEL 7000A103. Paints and topcoats of the types conventionally known and used in golf ball production (e.g., as coating layer 20) may be used as the base resin to contain roughening particles without departing from this invention.

Additional additives optionally may be incorporated into the resin, such as flow additives, mar/slip additives, adhesion promoters, thickeners, gloss reducers, flexibilizers, cross-linking additives, isocyanates or other agents for toughening or creating scratch resistance, optical brighteners, anti-yellowing agents, UV absorbers, and the like. The amount of such additives usually ranges from 0 to about 5 wt %, often from 0 to about 1.5 wt %.

The viscosity of the resin prior to application to the golf ball body may be about generally 16 to 24 seconds as measured by #2 Zahn cup. Generally the resin is thin enough to easily spray the coating onto the golf ball body, but thick enough to prevent the resin from substantially running after application to the golf ball body.

The thickness of the applied resin (after drying) typically ranges from of about 8 to about 50 μm, and in some examples, from about 10 to about 15 μm. When the particles are contained within the resin, the thickness of the resin may be less than the particle size in order to allow at least some of the particles to protrude from the resin.

The coating contains a plurality of particles, generally, 0.1 to 30 wt % particles based on total coating weight, and in some examples, from 3 to 10 wt %.

The coating may be clear or opaque and may be white or have a tint or hue or other coloring pigment. The particles may be of any color. Generally application of the coating and particles to the outside of the golf ball, if present in a sufficient amount, will give the ball somewhat of a dull or matte finish, as compared to the brighter or shinier finish of many conventional golf balls. The particles tend to diffuse some of the light in a clear coat, for example.

According to one aspect of the present invention, a coating is formed by applying and drying a resin on the surface of the golf ball body. The method of applying the resin is not limited. For example, a two-component curing type resin such as a polyurethane may be applied by an electrostatic coating method, or by a spray method using a spray gun, for example, after mixing an aqueous polyol liquid with a polyisocyanate. In the case of applying the coating with the spray gun, the aqueous polyol liquid and the polyisocyanate may be mixed bit by bit, or the aqueous polyol liquid and the polyisocyanate are fed with the respective pumps and continuously mixed in a constant ratio through the static mixer located in the stream line just before the spray gun. Alternatively, the aqueous polyol liquid and the polyisocyanate can be air-sprayed respectively with the spray gun having the device for controlling the mixing ratio thereof. Subsequently, the two-component curing type urethane resin on the surface of the golf ball body is dried.

In one aspect, the coating comprises resin (with any additives) and particles mixed therein. The coating is applied to the golf ball body such as described above. Prior to application to the golf ball body, the particles may be added to the resin as a separate ingredient, or may be pre-mixed with one of the components in a two-component coating composition.

In another aspect, a resin layer (with any additives) is applied to the golf ball body such as described above. Prior to drying, particles are applied to the top of the wet resin layer using a media blaster, sand blaster, powder coating device, or other suitable device. The particles may adhere to the surface and/or be embedded into the surface of the resin layer.

In another aspect, a very thin resin layer may be applied on top of the particles to hold the particles in place. Generally this resin layer is composed of the same resin layer initially applied, but may have a thinner viscosity. This additional thin layer of resin may be provided, if necessary or desired, to fine tune or somewhat reduce the exterior surface roughness of the ball.

Examples

Golf balls were prepared with the following coatings and then tested for various properties

- Inventive #1—Polyurethane Clear Coat with 5% to 10% by weight small silica particles (500 nm to 1 μm). Smooth appearance.
- Inventive #2—Polyurethane Clear Coat with 5% to 10% by weight large silica particles (1 μm to 5 μm). Rough, matte appearance.
- Comparative—Standard Polyurethane Clear Coat with no added silica particles.

Figure 5:
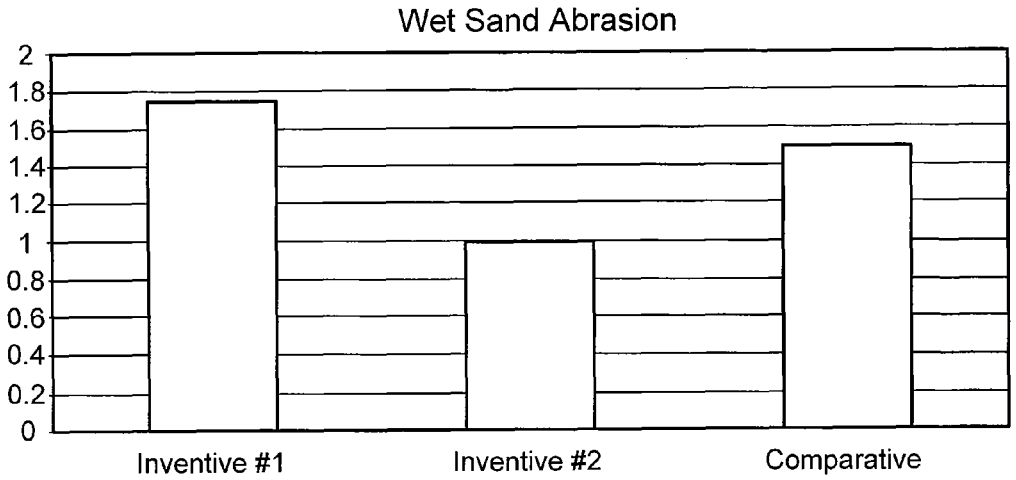
FIG. 5 depicts test results for Wet Sand Abrasion.

In the Wet Sand Abrasion test, balls were tumbled in wet sand for 8 hrs. The balls were compared visually. Lower scores indicated less damage to the ball. The balls were graded from 1 to 5 with 1 being the best and 5 being the worst. Attention is drawn to FIG. 5, which shows that Inventive Sample #2 had a lower (better) wet sand abrasion score as compared to that of the Comparative Sample.

Figure 6:
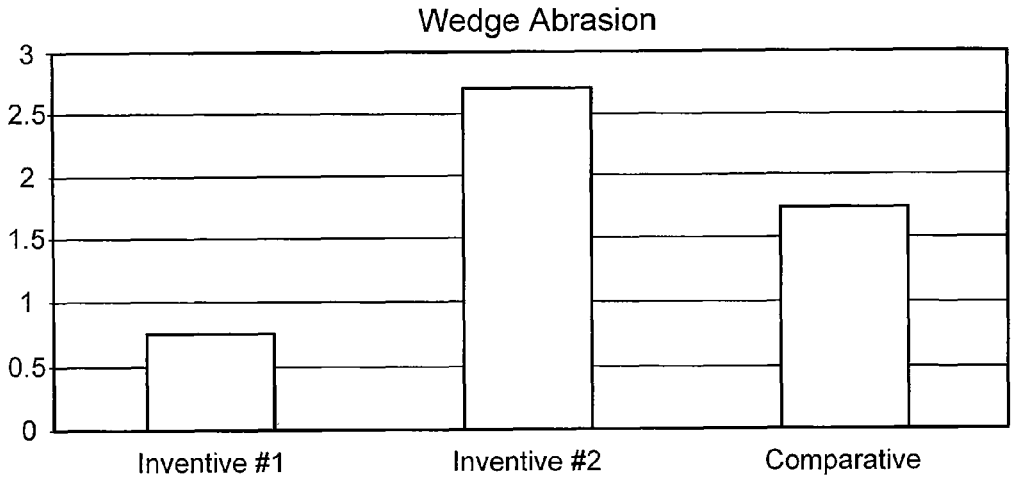
FIG. 6 depicts test results for Wedge Abrasion.

In the Wedge Abrasion test, balls were hit with a standard 56 deg. wedge and the degree of scuffing was visually analyzed. Lower scores again indicated less damage to the ball. The balls were graded from 1 to 5 with 1 being the best and 5 being the worst. Attention is drawn to FIG. 6, which shows that Inventive Sample #1 had a lower (better) wedge abrasion score as compared to that of the Comparative Sample.

Figure 7:
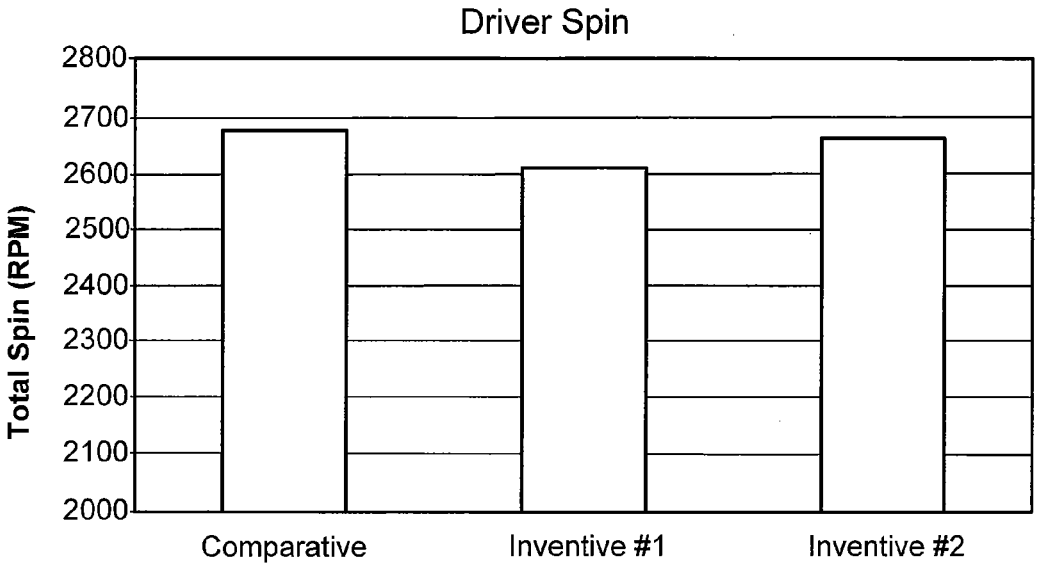
FIG. 7 depicts spin results of golf balls hit using a driver.
Figure 8:
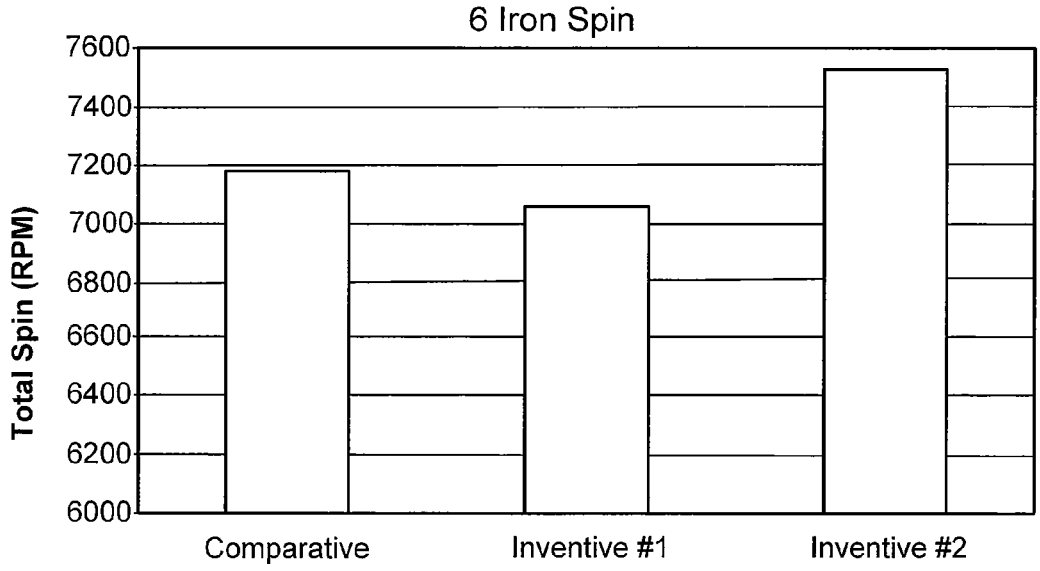
FIG. 8 depicts spin results of golf balls hit using a 6 iron.
Figure 9:
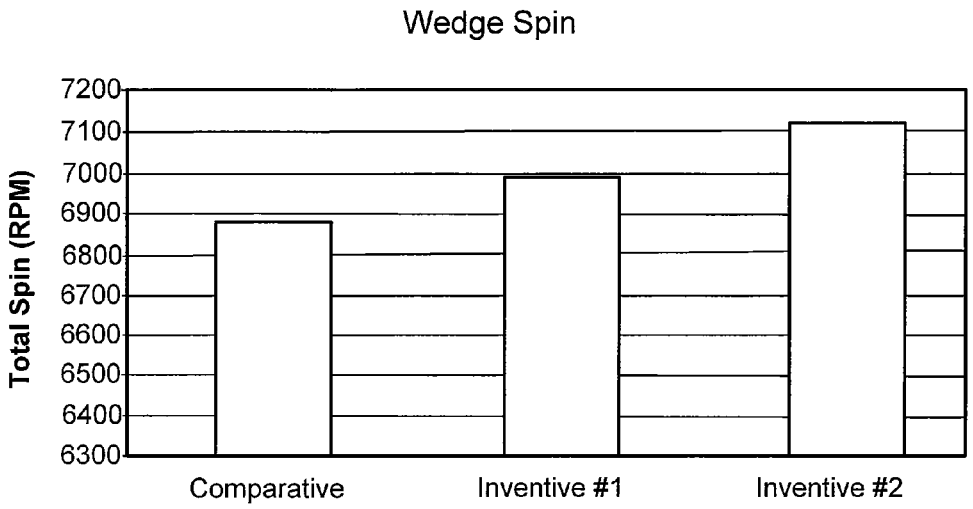
FIG. 9 depicts spin results of golf balls hit using a wedge.

The spin graphs (FIGS. 7-9) show the inventive coating can increase spin somewhat off of irons and wedges without increasing driver spin. This is advantageous for more distance and control off the driver (lower spin) and more control around the green (higher spin).

Aerodynamic Data

Golf balls in accordance with examples of this invention were subjected to various aerodynamic tests as described in more detail below.

In the following evaluation, the "surface roughness" (also called "Ra" in this specification) of various balls was evaluated. Surface roughness may be thought of as the arithmetic average of deviation from an ideal surface, and it may be calculated according to the following formula:

$$R_a = 1/n\sum_{i=1}^{n}|y_i|$$

where y represents the height of the surface's deviation from an "ideal surface" at a specific location and "n" represents the number of height deviation measurements made on the surface. The ideal surface may be defined as the location of the perfectly smooth surface without roughness or height deviations, e.g., the average surface location over the area measured. In at least some instances, the ideal surface may be defined by a "best fit" curve derived from a three-dimensional surface scan of the ball's surface (described in more detail below) and/or derived at least in part from CAD data representing the surface of the mold cavity from which the ball cover is formed (optionally taking into account the additional thickness provided by any post-mold coating(s)).

Figure 10A:
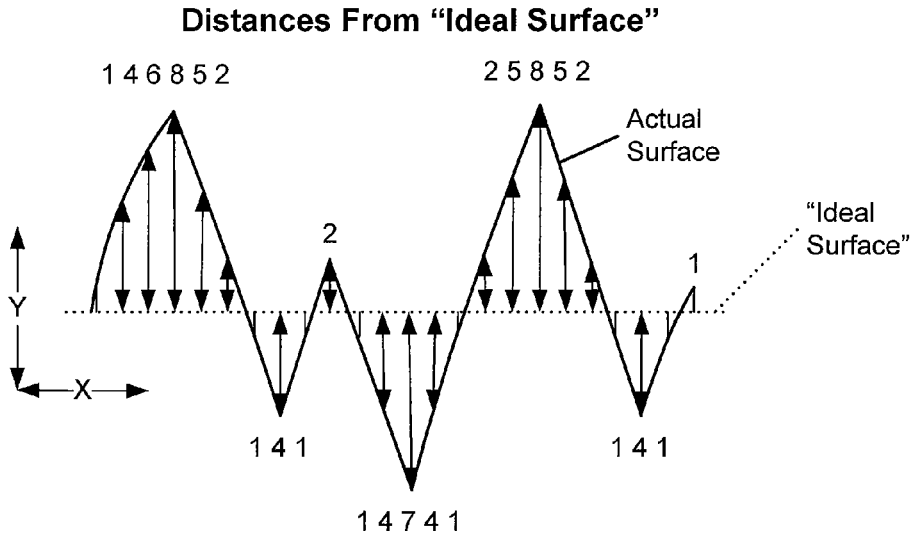
FIG. 10A is a diagram used in explaining measurement of surface roughness and deviation of an actual surface from an "ideal" surface.

Height deviation measurements may be made in any desired number and/or at any desired spacing around a ball without departing from this invention. FIG. 10A provides an example of the manner in which height deviation and surface roughness may be measured. In this example, while an ideal, smooth surface is illustrated (which may be flat or curved, e.g., corresponding to the curvature of a "perfect" ball or a "perfect" dimple, shown as a broken line in FIG. 10A), the actual surface (the solid line) is shown to have peaks and valleys. Measurements of the actual surface location with respect to the ideal surface location are made at constant spaced distances across the desired surface area (e.g., the entire surface of the ball, at selected locations around the ball surface, within or around one or more dimples, on one or more land areas, etc.), and that measured distance corresponds to the height in the "y" direction that the actual surface deviates from the ideal surface at that specific location. Then, the sum of the absolute values for these height deviations at all measured actual surfaces is divided by the total number of measurements taken to thereby provide an average roughness value for the ball ("Ra"), e.g., as indicated from the formula above.

Appropriate measurements of the change in the surface height (e.g., height deviations) may be made using three-dimension scanning systems as are known and commercially available (e.g., a system including a Hirox OL-350II lens, a Hirox KH-1300 microscope (available from Hirox-USA, Inc., River Edge, N.J.), a COMS Remote Controller CP-3R, Hirox KH-1300 Microscope Controller, COMS Position Controller CP-310, and a COMS CD-3R_MMMB Amplifier) . Such systems are capable of making three-dimensional models of an object being scanned.

As a more specific example, a three-dimension scanning system, like that described above, may be programmed to take about 4900 "pictures" around the area of a single dimple. More specifically, for a single dimple, 70 sub-pictures may be made (e.g., with a tiling factor (picture overlap) of 25%) over the surface area of the dimple (a 7×10 matrix of pictures) and its immediately surrounding area, and each sub-picture includes 70 pictures in the vertical direction (to locate the surface in the depth direction). These pictures (and subpictures) allow for computerized reconstruction of a representation of the actual dimple surface.

Another term used in this specification is called "micro surface roughness." "Micro surface roughness" is simply the Ra value described above, but only counting deviations from the ideal surface of 0.25 mm or smaller (although other cutoff values may be used without departing from this invention).

This parameter may be referred to herein as $Ra_x$, wherein "x" represents the desired upper limit of deviation considered to constitute "micro" surface roughness. Thus, deviations from the ideal surface location of 0.25 mm or less may be referred to herein as $Ra_{0.25}$, deviations from the ideal surface of a height of 0.3 mm or less may be referred to herein as $Ra_{0.3}$, etc. The sum of all surface roughness (e.g., with no upper limit or cut off height, with a cut off height of 80 mm, etc.) also is referred to in this specification as "macro surface roughness." Thus, "micro surface roughness" may be thought of as the portion of overall or macro surface roughness contributed by height deviations of 0.25 mm or less (or other desired upper limit, as noted above).

Any desired manner of measuring surface roughness and/or deviation of an actual surface from an "ideal surface" may be used without departing from this invention to determine both "macro surface roughness" and "micro surface roughness," although the three-dimensional scanning system described above was used in the tests described below.

In these experiments, a golf ball model having a smooth exterior coating was used as the control ball. This ball model had a three piece construction with a thermoplastic polyurethane cover. For the inventive balls, the same ball construction, dimple pattern, and materials were used, except silica particles were incorporated into the polyurethane clear coat applied to the balls such that the balls had a rough, matte appearance (the control balls have this same type of coating without the additional silica particles added thereto).

Figure 10B:
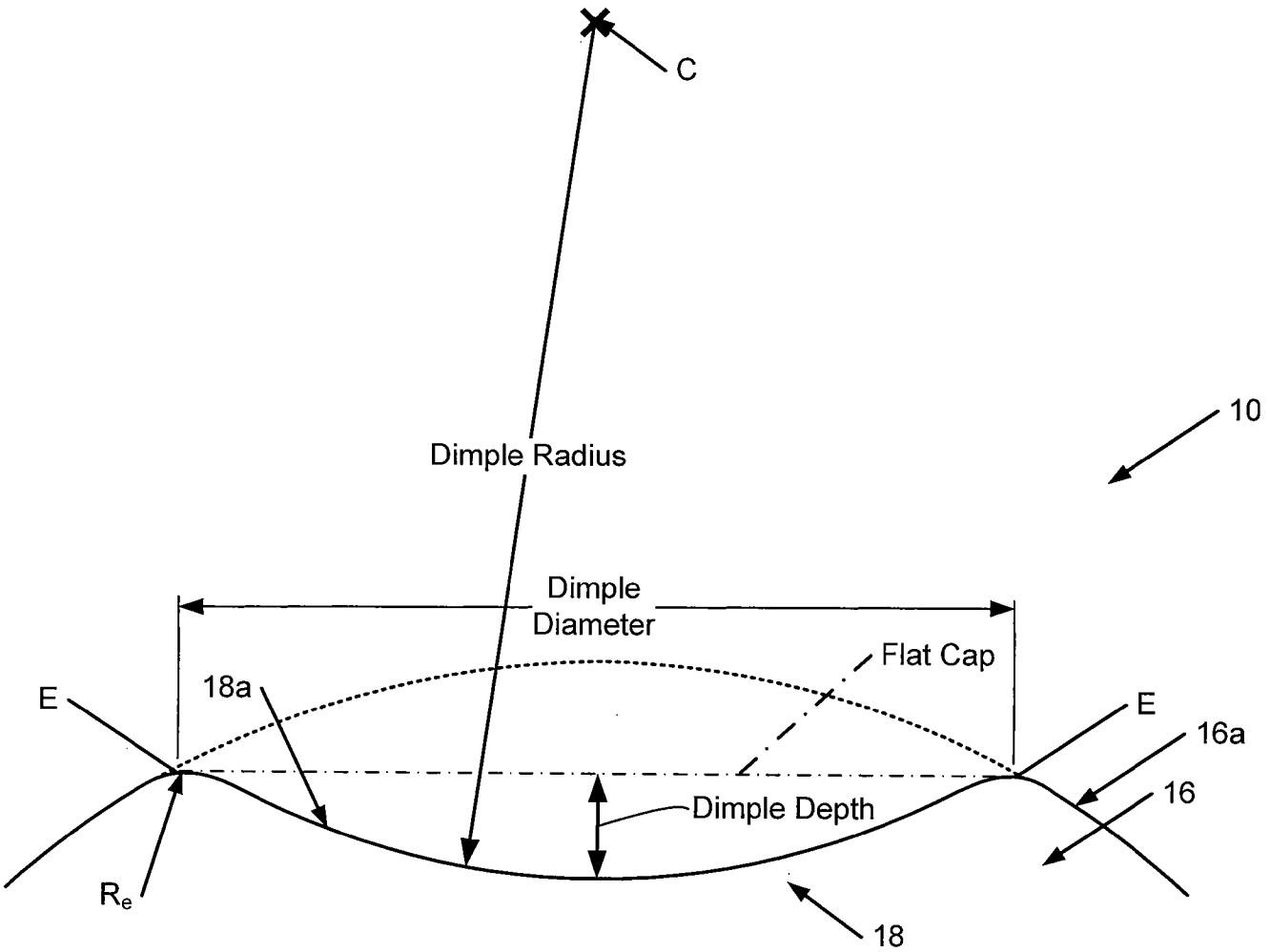
FIG. 10B is a diagram used in explaining various dimple parameters of a golf ball in accordance with this invention.

FIG. 10B provides an illustration that helps to explain certain dimple properties as those terms are used in this specification. FIG. 10B illustrates a partial cross-sectional view of a portion of a golf ball cover layer 16 with a dimple 18 formed in it prior to coating (the other layers of the ball and the coating are omitted to improve clarity). The partial cross-sectional view of FIG. 10B is taken at a center of dimple 18 that has a round outer perimeter surface edge shape (when looking directly down at the dimple 18 on the ball's surface). As shown in FIG. 10B, the majority of this example dimple 18 has a circular arc cross-sectional shape. Thus, the dimple 18 is said to have a "dimple radius," wherein the center C of this dimple radius is located outside of the ball 10.

Dimples 18 in accordance with at least some examples of this invention may have a sharp or abrupt corner at the junction of the surface 16*a* of the cover layer 16 and the interior surface 18*a* of the dimple 18. Often, however, as shown in FIG. 10B, the dimple edge will be more rounded, e.g., having an edge radius $R_e$. While any desired edge radius may be provided in dimple constructions in accordance with examples of this invention, in some more specific examples, the edge radius $R_e$ will be in the range of 0.1 to 5 mm, and in some examples, within the range of 0.25 to 3 mm or even within the range of 0.25 to 1.5 mm. Such dimples 18 may still be considered to have a spherical sector shape and a circular arc cross sectional shape even when the extreme edges of the dimple 18 have a different shape (such as a rounded corner or edge) to facilitate transition between the interior dimple surface 18*a* and the outermost cover layer surface 16*a*.

In dimples 18 of the type illustrated in FIG. 10B, the dimple has no clear cut beginning or edge. Thus, as used in this specification, the edge (or perimeter) of the dimple 18 may be determined by locating the points E at which tangents at the exact opposite sides of the dimple 18 are parallel (to thereby provide the single dot-dash line shown in FIG. 10B labeled "Flat Cap"). These tangent points can be located, in effect, by laying a "flat cap" down over the dimple and finding the location on the ball surface on which this cap rests (e.g., using CAD representations of dimples). These tangent points E define the dimple 18 edge E, and for dimples having a round perimeter edge, the distance between the opposite tangent points E is defined as the dimple's "diameter" as that term is used in this specification. For dimples having other perimeter shapes (such as polygons, ellipses, ovals, etc.), a similar dimple dimensional size may be defined, such as length, width, major axis, minor axis, major radius, minor radius, chord length, diagonal length, etc.

The dimple's "depth," as used in this specification, means the dimension of the dimple from its deepest point to the tangent "flat cap" line, as shown in FIG. 10B. For spherical sector dimples having a circular arc cross sectional shape, this dimple "depth" will be measured at the geometric center of the dimple 18, from the flat cap line to the dimple interior surface 18*a* at the dimple 18's center.

The control golf balls (including their "smooth" polyurethane clear coat) were used in these tests and similar balls, but with the rough exterior clear coat (including silica roughening particles) were used (Inventive Balls #2 described above). Two of the control balls weighed 45.3559 g and 45.3883 g, respectively, and two of the balls treated in accordance with this invention weighed 45.7568 g and 45.7448 g, respectively. A Mettler Toledo scale was used for the weight measurements. While the roughened balls were on average 0.379 grams heavier than the smooth balls (0.8% heavier), this difference is believed to have a negligible effect on the comparative trajectories of these two types of balls (as estimated by the estimation model provided by Bissonnette, et al., in U.S. Pat. No. 6,729,976, which patent is entirely incorporated herein by reference).

Any desired amount of the surface area of the ball may be measured to determine the surface roughness (both micro and macro) for the ball. Preferably, measurements will be made over sufficient areas dispersed around the ball to provide an adequate sampling so that the determined roughness values can be statistically attributed to the entire ball. For these experiments, multiple dimples of each dimple type on the ball were measured (including the dimple itself and a portion of its surrounding area), and each of the measured dimples was measured two or three times. The average of the surface roughness measurements for the multiple measurements of each dimple was used as the result for that dimple. This procedure resulted in the measurement of 36 total dimples (each measured 2 or 3 times, as noted above), and the measured locations were dispersed around the golf ball surface.

In some example surface roughness measuring tests for this invention, the roughness of at least 7.5% of the ball's overall surface area will be measured, optionally in at least 36 discrete areas dispersed around the ball surface, and this measured surface roughness will be considered the surface roughness of the entire ball. For some measurement techniques, the discrete areas will be centered on or fully contain a dimple, and measurements will be made on at least six different dimples of each size (provided that the ball has at least six dimples of each size, and if not, all dimples of that size will be measured). The dimples measured should be dispersed around the ball (e.g., dimples on opposite sides or hemispheres of the ball) so as to provide a good overall estimate of the surface roughness. Dimples are considered to be of the "same size" if the dimples are intended to have the same size and shape after they are molded (e.g., the same perimeter shape, profile shape, depth, height, diameter, diameter to depth ratio, etc.) and before coating takes place. Dimples will be considered to be of the "same size" if the CAD or other "blueprint" data for making the mold cavity for forming the dimples indicates that the dimples are intended to have the same size and shape.

Figure 11A:
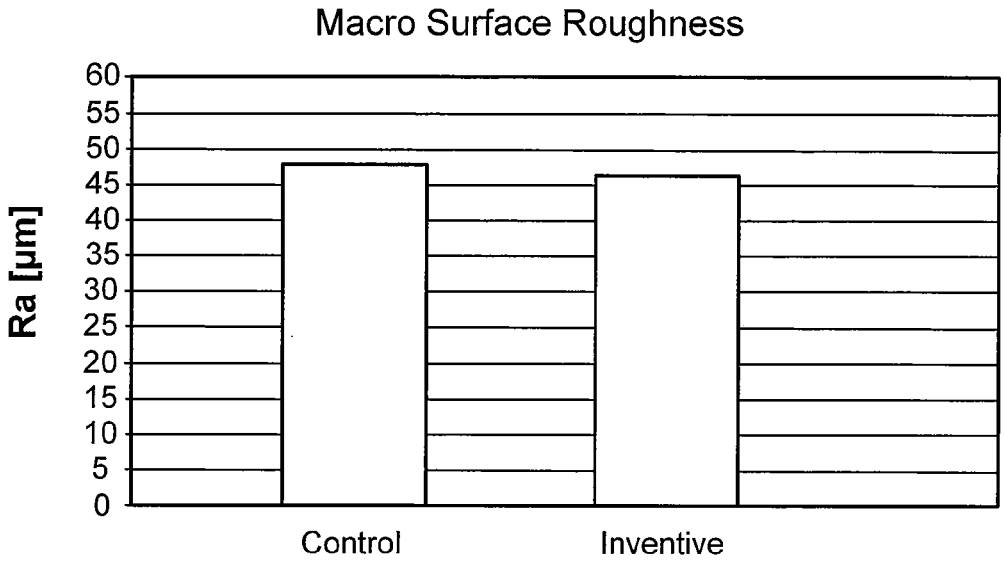
FIG. 11A through 11D are charts illustrating macro surface roughness and micro surface roughness features for various dimples of: (a) roughened balls in accordance with examples of this invention and (b) smooth control balls.
Figure 11B:
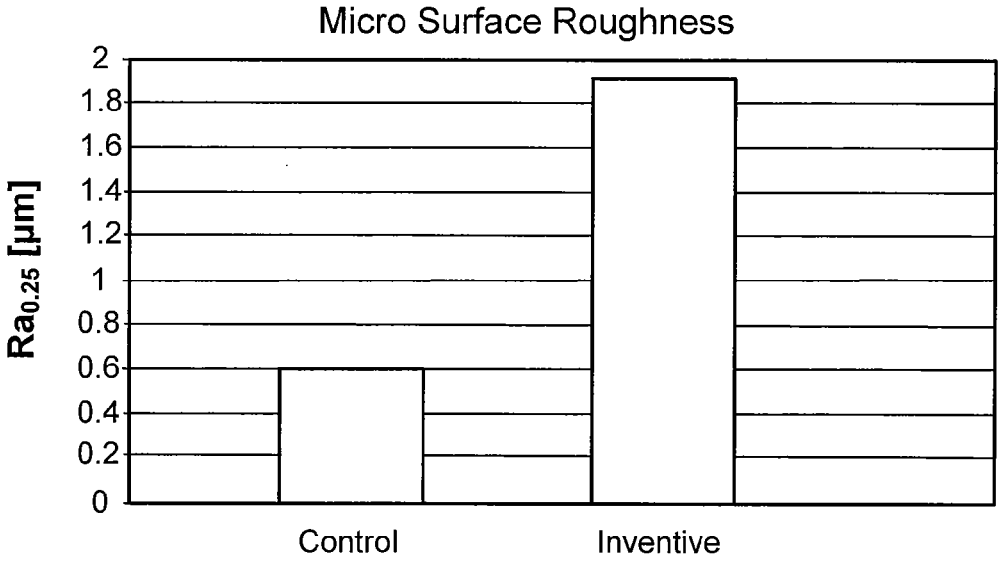

The macro and micro surface roughnesses of the control balls and the inventive balls were measured using scanning equipment as described above, and the measurement results for one dimple size are shown in FIGS. 11A and 11B. As shown in FIG. 11A, the macro surface roughness Ra is substantially the same for both balls (each having an $Ra_{80mm}$ of about 46 to 47 μm). This stands to reason because the ball's dimples constitute the main contributor to macro surface roughness as the ball's overall surface roughness is dominated by the presence of the dimples (i.e., the overall surface roughness contribution due to the microparticles is small as compared to the overall surface roughness contribution due to the much larger dimples). Notably, however, as shown in FIG. 11B, the dimples on the two ball types have significantly different micro surface roughnesses ($Ra_{0.25mm}$, in this example). The noted dimples of the smooth, control balls had a micro surface roughness of about 0.6 μm, while the corresponding dimples of the balls including the silica particles to roughen their surface have a micro surface roughness of about 1.9 μm.

Figure 11C:
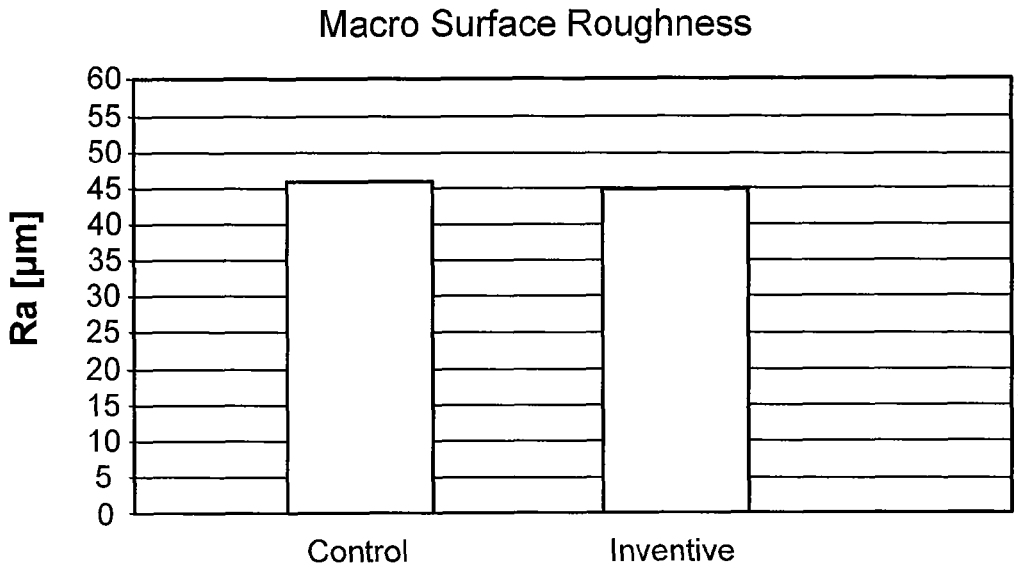
Figure 11D:
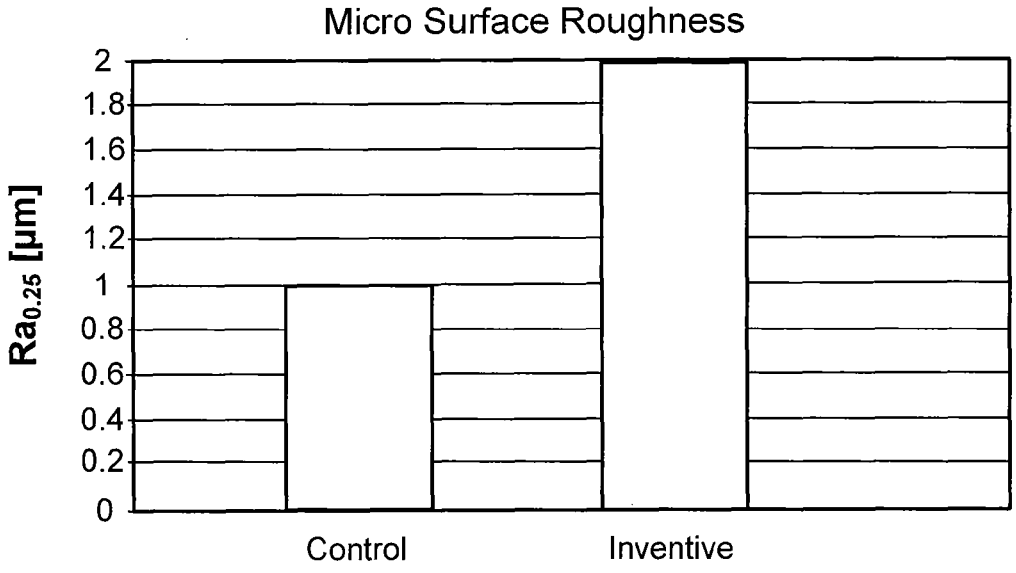

Additionally, the macro and micro surface roughnesses of another dimple type of the control balls and the inventive balls were measured, and the measurement results are shown in FIGS. 11C and 11D. As shown in FIG. 11C, the macro surface roughness Ra is substantially the same for both balls (each having an $Ra_{50mm}$ of about 45 to 46 μm). Notably, however, as shown in FIG. 11D, these dimples on the two ball types have significantly different micro surface roughnesses ($Ra_{0.25mm}$, in this example). The noted dimples of the smooth, control balls had a micro surface roughness of about 1.0 μm, while the corresponding dimples of the balls including the silica particles to roughen their surface have a micro surface roughness of about 1.96 μm.

The following Table provides the average micro and macro surface roughnesses as measured for the various dimple types on the control "smooth coated" ball and on the inventive "rough coated" ball:

TABLE 1

MACRO AND MICRO SURFACE ROUGHNESS MEASUREMENTS

| Dimple Type | Roughened Ball - Micro Surface Roughness [μm] $Ra_{0.25\ mm}$ | Control Ball - Micro Surface Roughness [μm] $Ra_{0.25\ mm}$ | Roughened Ball - Macro Surface Roughness [μm] $Ra_{80\ mm}$ | Control Ball - Macro Surface Roughness [μm] $Ra_{80\ mm}$ |
|---|---|---|---|---|
| A | 1.90 | 0.76 | 44.83 | 46.97 |
| B | 2.25 | 0.88 | 41.78 | 36.04 |
| C | 2.19 | 0.76 | 35.64 | 37.70 |
| D | 2.38 | 0.59 | 45.71 | 46.14 |
| E | 1.90 | 0.60 | 46.10 | 47.30 |
| F | 1.96 | 1.00 | 44.91 | 45.90 |
| Ave | 2.10 | 0.77 | 43.2 | 43.3 |

Thus, the roughened ball had more than 1.75 times the micro surface roughness ($Ra_{0.25mm}$) as compared to the same ball construction without a roughened final coating (e.g., without silica particles provided in and/or adhered to the polyurethane clear coat), while the macro surface roughness remained relatively constant. For some of the measured dimples, the roughened ball had more than 2 times and even more than 3 times the micro surface roughness as compared to its smooth counterpart. As noted above, as used herein, balls will be considered to have the "same ball construction" if they are made to the same construction specifications with the exception of the roughening material incorporated into the structure (e.g., same core size and materials, same intermediate layer(s) size(s) and material(s), same cover size and material, same dimple patterns (positions and sizes), etc.).

At least some advantageous aspects of this invention (as will be described in more detail below) may be realized for roughened balls that have at least 1.75 times the micro surface roughness ($Ra_{0.25\ mm}$) as the same ball construction without a roughened final coating, and in some examples, in balls having at least 2 times the micro surface roughness ($Ra_{0.25\ mm}$) or even at least 2.5 or 3 times the surface roughness ($Ra_{0.25mm}$). Micro surface roughness may be measured in any desired manner, provided it is measured consistently on the two ball surface's being compared and is capable of measuring height deviations less than or equal to the desired micro surface roughness limit. Also, the three-dimensional scanning process described above may be used for measuring dimple micro and macro surface roughnesses.

The dimple scanning process described above found that, for dimples of the same type (e.g., comparing the measured E dimples noted above), the roughened (inventive) ball had slightly deeper dimples (on average) as compared to the smooth (control) ball (e.g., about 158 μm v. 150 μm, respectively, for Dimple Type E and about 152 μm v. 146 μm, respectively, for Dimple Type F). Typically, for dimples of a common diameter (with other factors being equal), shallower dimples (and an increased dimple diameter to depth ratio) will lead to higher trajectories. See, T. Sajima, et al., "The Aerodynamic Influence of Dimple Design on Flying Golf Ball" in Springer (ed.) Engineering of Sport 6, pp. 143-148, which article is entirely incorporated herein by reference. From this "conventional wisdom," due to its somewhat deeper dimples, if any ball trajectory change is noted, one would expect the roughened (inventive) ball to have a lower trajectory as compared to its smooth (shallower dimpled) counterpart control ball. As shown in the ITR data described below, however, the roughened ball in accordance with this invention in fact had a higher trajectory than is smooth counterpart.

The aerodynamic performances of the golf balls were tested using an Indoor Test Range ("ITR") corresponding to that used by the United States Golf Association ("USGA") for testing golf balls for conformance with USGA rules. This equipment and the USGA testing procedures are commonly known and used in the golf ball art, so further detailed description will be omitted. This system is capable of measuring and/or determining the non-dimensional parameters of Reynolds number ("Re") and Spin Ratio (S.R.) at which each ball is launched, as well as the coefficient of lift ("$C_L$") and the coefficient of drag ("$C_D$") experienced by the ball during its flight. For ITR measurements in this experiment, in accordance with typical practice, six balls of every ball type (i.e., the smooth, control golf ball and the modified rough coated version of this same ball) were shot through the ITR system, and each ball was shot in a "seam orientation" (i.e., seam aligned with a vertical plane and oriented in the direction of launch) and a "pole orientation" (i.e., seam aligned with a horizontal plane). Moreover, the balls were launched through the ITR system at 15 different Reynolds number and spin ratio combinations (for a total of 180 ITR shots and measurements per ball type), ranging from Reynolds number of about 72,000 to Reynolds number of about 220,000. The fifteen Reynolds number and spin ratio settings corresponded to those used in conventional USGA testing.

The launch conditions, initial velocity, starting angle, and spin for driver shot simulation during some ITR testing were set to about 266 km/h (242 ft/sec), 11.3°, and 44.7 revolutions/sec (2682 RPM), respectively, to mimic launch conditions of a typical professional golfer (these are average driver launch conditions measured in 2009 on the PGA Tour). Various other launch conditions also were tested, e.g., at various different Reynolds number and spin ratio conditions, as noted above.

Figure 12:
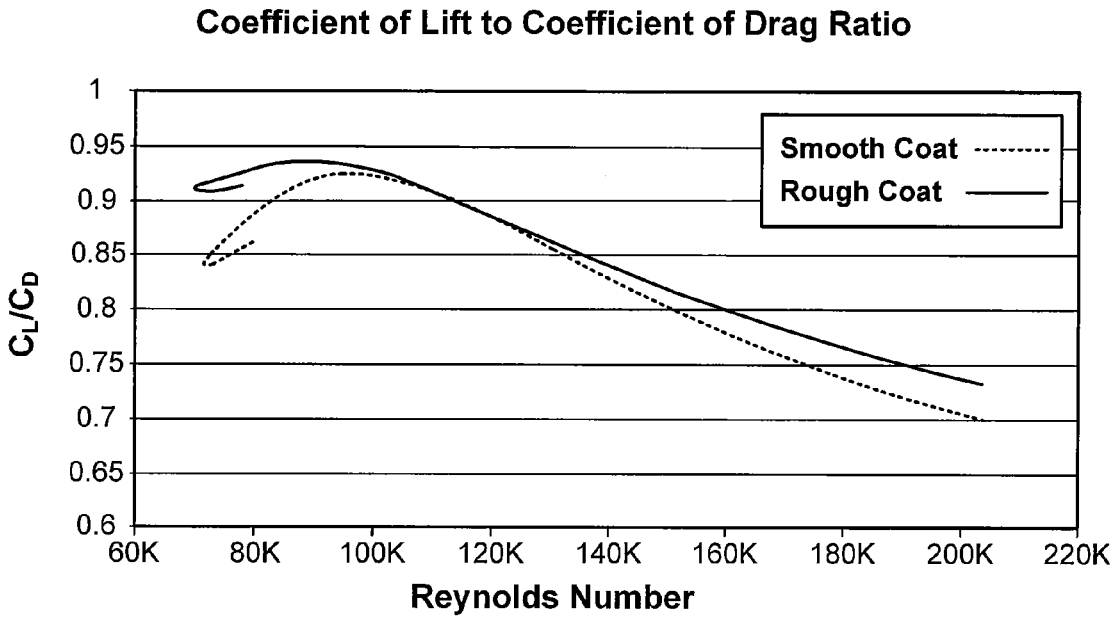
FIG. 12 is a graph illustrating the ratio of coefficient of lift against coefficient of drag for roughened balls in accordance with examples of this invention and smooth control balls at various Reynolds number and/or other launch conditions.

FIG. 12 is a graph showing the measured coefficient of lift to coefficient of drag ratio ($C_L/C_D$) over the tested range of Reynolds numbers using ITR testing for the smooth coated (control) balls and the rough coated (inventive) balls with the balls launched in the pole position. Notably, the roughened (inventive) balls displayed a higher $C_L/C_D$ ratio over all or substantially all of the Reynolds number range tested. The difference in $C_L/C_D$ ratio is most prominent at the extreme ends of the test ranges. For example, as shown in FIG. 12, at a Reynolds number of about 72,000, the smooth control ball had a $C_L/C_D$ ratio of about 0.84, while the roughened (inventive) ball had a $C_L/C_D$ ratio of about 0.91 (more than an 8% higher $C_L/C_D$ ratio). Also, at a Reynolds number of about 205,000, the smooth control ball had a $C_L/C_D$ ratio of about 0.70, while the roughened (inventive) ball had a $C_L/C_D$ ratio of about 0.73 (more than a 4% higher $C_L/C_D$ ratio).

Figure 13:
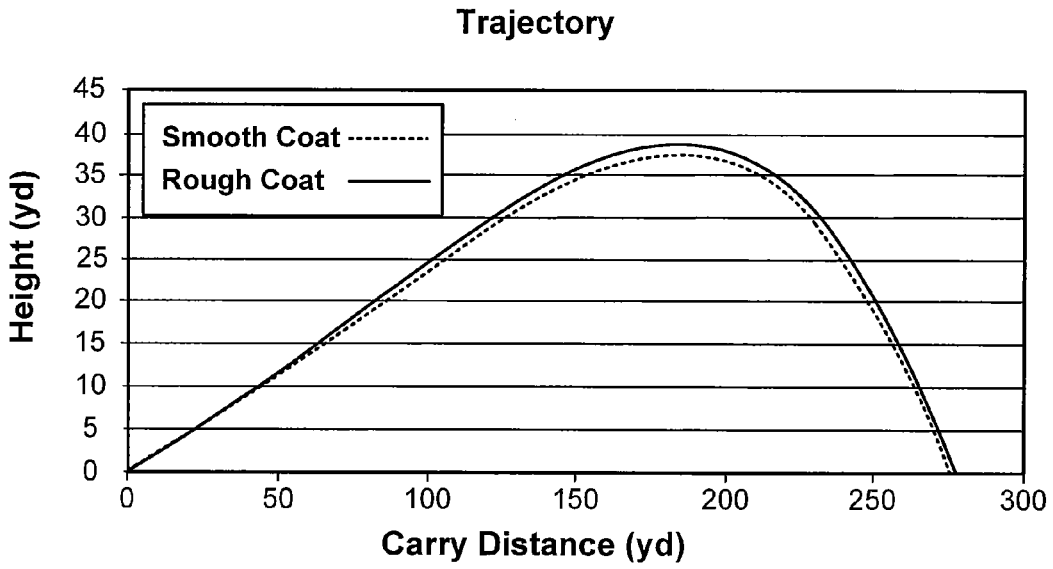
FIG. 13 is a graph illustrating vertical trajectory for roughened balls in accordance with examples of this invention and smooth control balls as launched under conditions representative of those of an "average" professional player.

The difference in trajectories (vertical) between these two ball types (with the balls launched in the pole orientation) is illustrated in the graph of FIG. 13, which shows a plot of ball height against ball flight carry yardage. Notably, the apex of the roughened (inventive) ball is about 1.4 yds (1.28 m) higher than that of the smooth (control) ball. The overall difference in carry length is 1.46 yds (1.33 m), with the roughened (inventive) ball having the longer carry. The following Table provides some additional data obtained during ITR testing of these two types of balls.

TABLE 2

DRIVER SHOT SIMULATION DATA FOR TESTED BALLS IN POLE ORIENTATION

| Parameter | Control Ball | Inventive Ball | % Difference |
|---|---|---|---|
| Speed (ft/s) (Predetermined Launch Condition) | 242 | 242 | 0 |
| Launch Angle (°) (Predetermined Launch Condition) | 11.3 | 11.3 | 0 |
| Spin (rev/s) (Predetermined Launch Condition) | 44.7 | 44.7 | 0 |
| Carry (yd) | 275.8 | 277.2 | +0.51% |
| Loft Time (s) | 7.18 | 7.39 | +2.9% |
| Total Distance (yd) | 291.2 | 292.4 | +0.41% |
| Descent Angle (°) | 41.4 | 41.8 | +1.0% |
| V (f) | 94.8 | 92.7 | −2.2% |
| Max Height (yd) ("Apex") | 37.5 | 38.9 | +3.7% |
| Carry Distance at Max Height (yd) | 185.7 | 184.0 | −0.92% |
| Max Angle Player Sees (°) | 12.38 | 12.93 | +4.4% |

Notably, the ball in accordance with the example of this invention has a longer carry, a longer flight time, and a higher apex.

Figure 14:
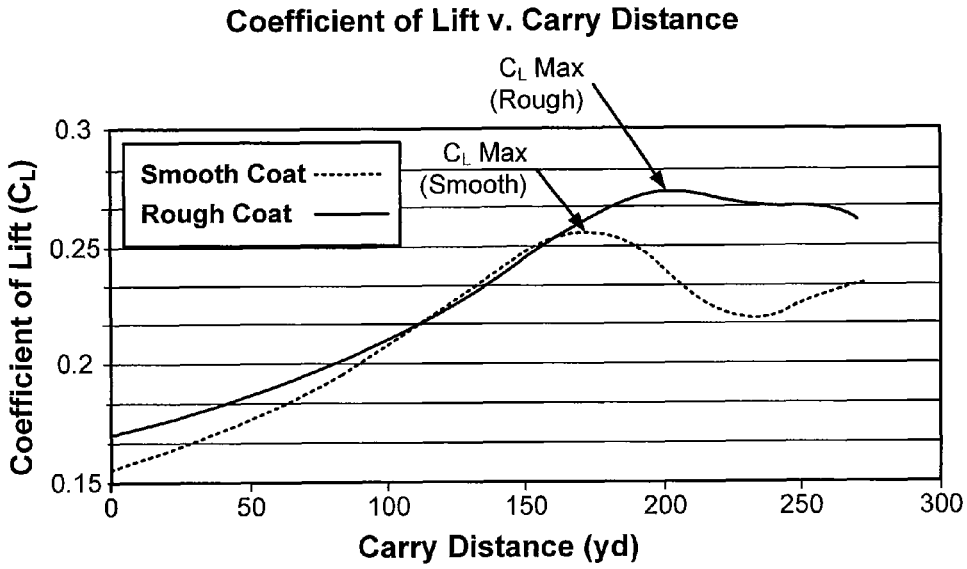
FIG. 14 is a graph illustrating coefficient of lift v. carry distance for roughened balls in accordance with examples of this invention and smooth control balls as launched under conditions representative of those of an "average" professional player.
Figure 15:
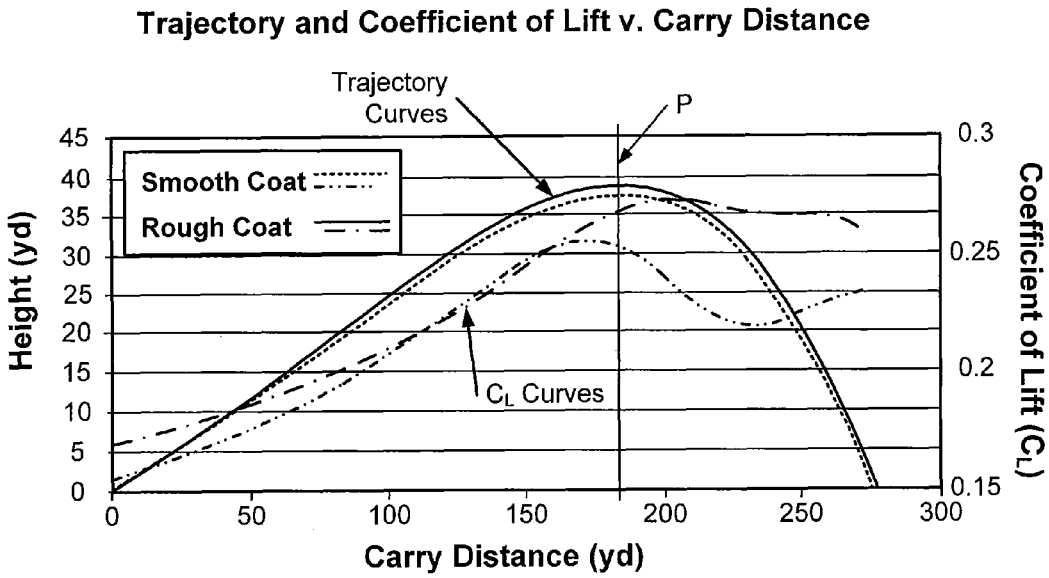
FIG. 15 combines the data of FIGS. 13 and 14 on a single graph to allow consideration of certain aspects and features of the measured data.

FIG. 14 shows a plot of the coefficient of lift ($C_L$) for the two ball types tested under the above noted driver launch conditions for FIG. 13 throughout the flight (in the pole orientation), and FIG. 15 shows both the trajectory curves (from FIG. 13) and the coefficient of lift data (from FIG. 14) in a single graph plotted against the carry distance. Notably, these figures show an increase in the coefficient of lift throughout almost the entire ball flight trajectory. More specifically, as shown in these figures, early in the flight (e.g., at launch and inside 80 yards of carry), the roughened (inventive ball) has a higher coefficient of lift than the control ball. As a golf ball is launched with backspin, the lift force helps get the ball into the air and fly farther because the lift force counteracts against gravitation forces pulling the ball back down to the ground (and thus, depending on spin conditions, a higher coefficient of lift at launch can be beneficial, at least for some players). From about 100 yards to 165 yards of carry, the coefficients of lift for the two ball types are substantially the same. As the balls reach their apexes (e.g., from about 170 yds of carry and beyond), however, dramatic differences in the coefficient of lift are shown. More specifically, as shown in FIGS. 14 and 15, the roughened (inventive) ball maintains a relatively high coefficient of lift beyond the flight apex (e.g., greater than or about 0.26) as compared to the coefficient of lift for the control ball (which dipped to about 0.22). Moreover, the roughened (inventive) ball's coefficient of lift remains higher than that of the control ball throughout the balls' descents. This is shown in FIG. 15 by the vertical separation of the $C_L$ curves beyond the upper peaks in the trajectory curves (i.e., to the right of line P located at the area of the trajectory peaks of the two balls). Maintaining as high a coefficient of lift as possible at the end of the ball flight (i.e., after the ball's apex) is desirable for at least some players because this tends to keep the ball up in the air a little longer during descent, thereby providing longer carry distances (e.g., balls having low coefficients of lift after the apex tend to have a flight that appears more like "dropping out of the sky").

Notably, FIGS. 14 and 15 also show that the coefficient of lift for the roughened (inventive) ball reaches its peak or maximum ($C_L$ Max) at a greater carry distance (about 200 yds) than the location of the coefficient of lift peak or maximum ($C_L$ Max) for the control ball (at about 173 yds). Thus, in this example, the roughened ball experienced an increased coefficient of lift and an increasing coefficient of lift through a longer portion of the ball's flight (as compared to the control ball).

The following Table provides some additional ITR test results and data (measured as described above) for both the pole and seam orientations for golf balls in accordance with examples of this invention and their smooth coated counterparts.

TABLE 3

ITR DATA FOR VARIOUS PARAMETERS OF GOLF BALLS

| | Control Ball - Pole | Inventive Ball - Pole | Pole % Difference (Rough v. Smooth) | Control Ball - Seam | Inventive Ball - Seam | Seam % Difference (Rough v. Smooth) |
|---|---|---|---|---|---|---|
| Max $C_D$ | 0.286 | 0.298 | +4.20% | 0.314 | 0.311 | −0.96% |
| Max $C_L$ | 0.256 | 0.273 | +6.64% | 0.280 | 0.290 | +3.57% |
| X | 172.7 yd | 202.0 yd | +17.0% | 205.2 yd | 220.9 yd | +7.65% |

TABLE 3-continued

| ITR DATA FOR VARIOUS PARAMETERS OF GOLF BALLS | | | | | | |
|---|---|---|---|---|---|---|
| | Control Ball - Pole | Inventive Ball - Pole | Pole % Difference (Rough v. Smooth) | Control Ball - Seam | Inventive Ball - Seam | Seam % Difference (Rough v. Smooth) |
| Location of Max $C_L$ | | | | | | |
| Y Height of Max $C_L$ | 37.0 yd | 37.8 yd | +2.16% | 34.7 yd | 31.9 yd | −8.07% |
| Max $C_L/C_D$ | 0.924 | 0.935 | +1.19% | 0.907 | 0.938 | +3.42% |
| $C_L/C_D$ at Launch | 0.699 | 0.733 | +4.86% | 0.670 | 0.706 | +5.37% |
| $C_D$ at Launch | 0.223 | 0.232 | +4.04% | 0.222 | 0.231 | +4.05% |
| $C_L$ at Launch | 0.156 | 0.170 | +8.97% | 0.149 | 0.163 | +9.40% |
| Total Carry Distance | 275.8 yd | 277.2 yd | +0.51% | 277.3 yd | 277.7 yd | +0.14% |
| Max Height | 37.5 yd | 38.9 yd | +3.73% | 36.0 yd | 36.7 yd | +1.94% |
| Carry Distance at Max Height | 185.7 yd | 184.0 | −0.92% | 183.8 yd | 182.5 yd | −0.71% |

Micro Surface Roughening by Abrasion

According to one embodiment, micro surface roughness can be imparted on a golf ball by roughening the exterior surface of the ball through abrasion to include deviations in the exterior surface of the ball in a sufficient amount such that the micro surface roughness of the ball is increased. The method of abrading the ball is not limited and includes various methods of subjecting the ball to abrasion by contact with abrasive material. Example methods of abrading include rubbing the ball against an abrasive material, rolling or tumbling the ball against an abrasive material, and/or blasting the ball with abrasive material. Abrasive material can include, for example, a loose aggregate of abrasive particulate (e.g. sand, crushed minerals, etc.), a bonded abrasive, a coated abrasive (e.g. sand paper), a pumice, a sharp surface, wire or other stiff bristles or brushes, and/or a scored surface.

Figure 16A:
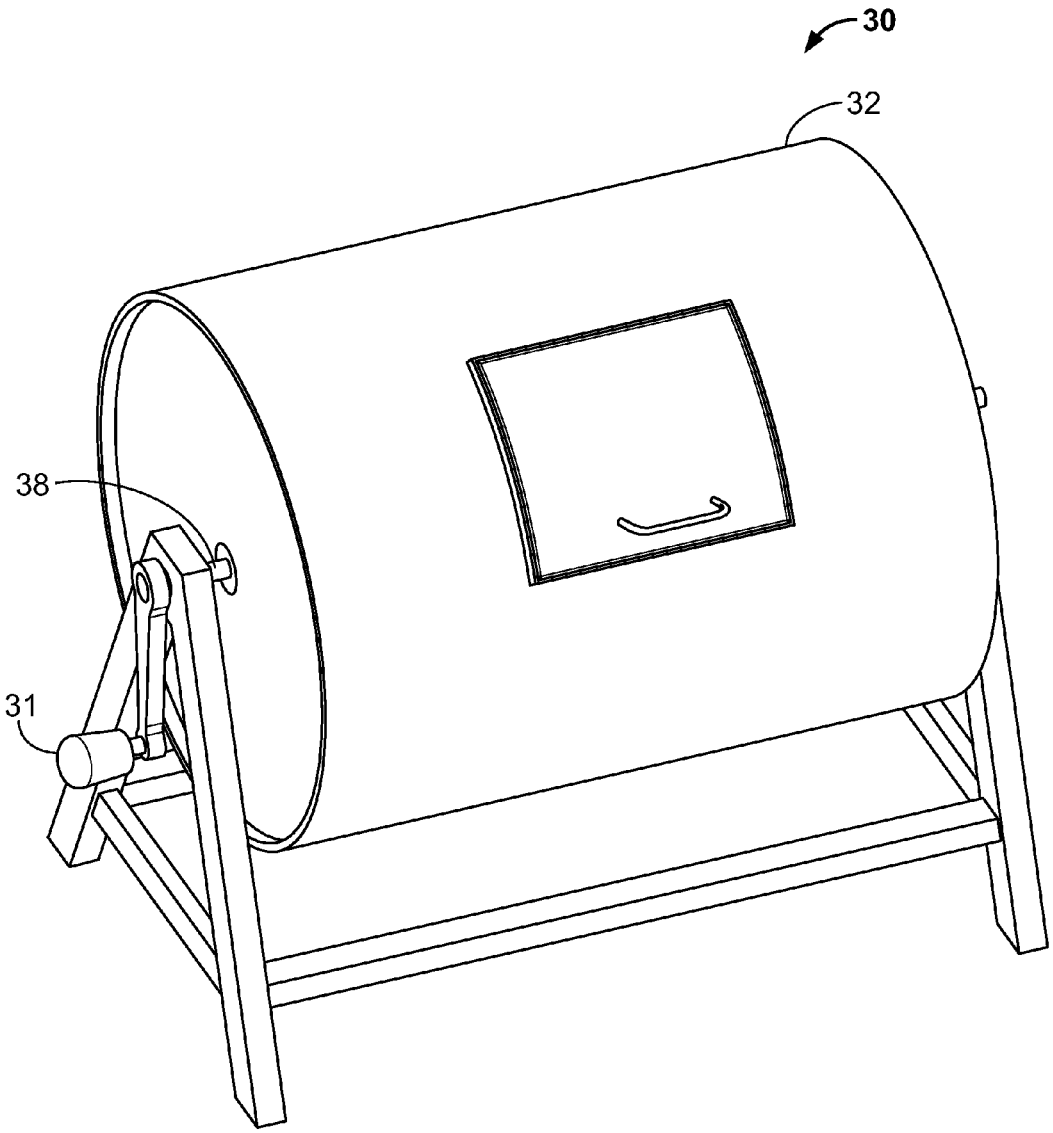
FIG. 16A through FIG. 16D depict example embodiments of golf ball roughener systems in accordance with examples of this disclosure.
Figure 16B:
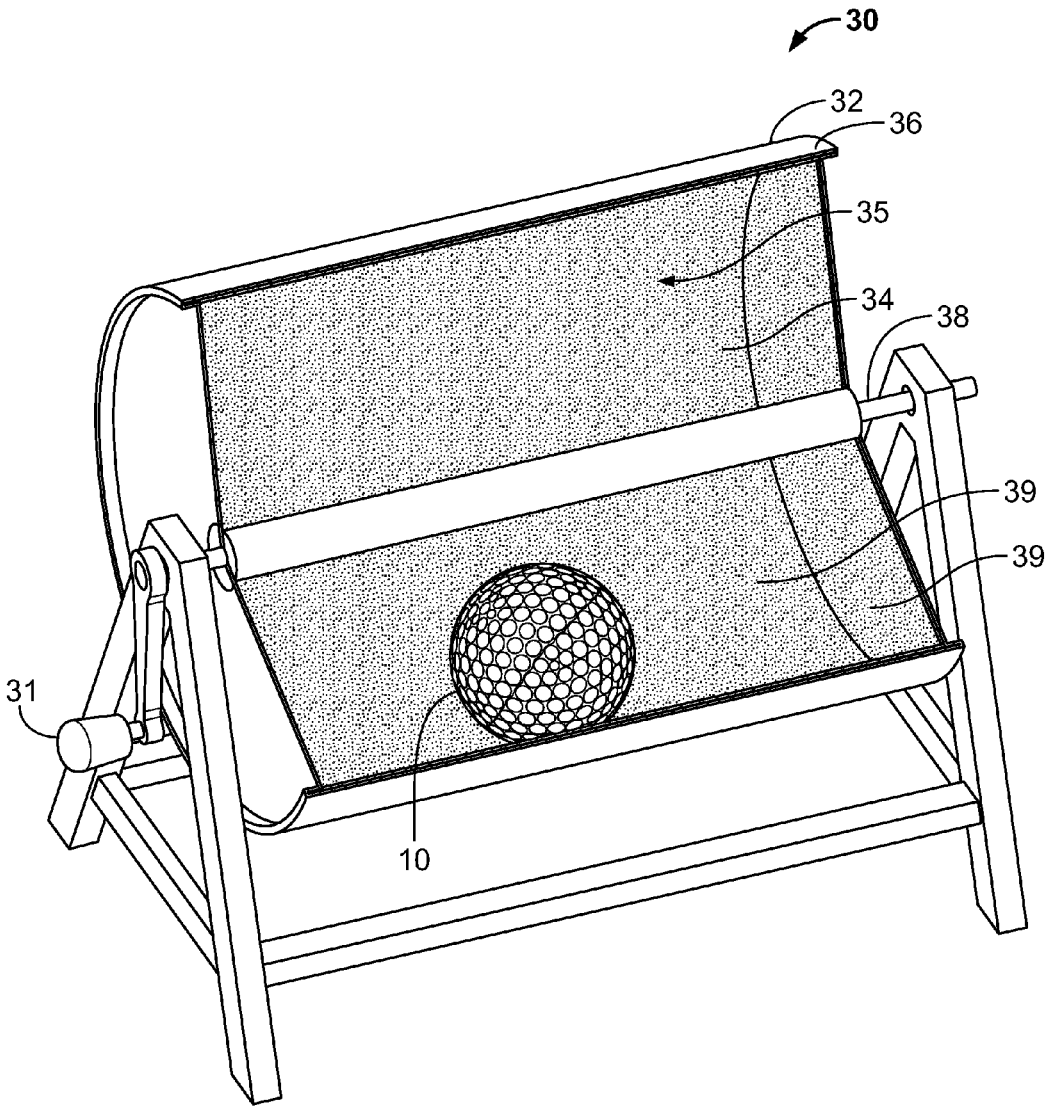

Roughening of a golf ball through abrasion to impart increased micro surface roughness on the ball can be performed using a golf ball roughener having an abrasive material. Referring to FIGS. 16A and 16B, in one embodiment, the golf ball roughener is a rotable tumbler 30. The rotable tumbler 30 can include a drum 32 having an inside surface 34 and an outside surface 36. The inside surface 34 can define an inside volume 35 within which, for example, at least one golf ball 10 can be contained. The drum 32 can be rotated about a center axis 38. The drum 32 can be rotated manually by, for example, turning a handle 31 connected to the center axis 38 or spinning the drum 32. The drum 32 can also be rotated automatically by, for example, use of a rotary motor. The inside surface 34 and/or inside volume 35 of the drum 32 can include an abrasive material 39 for subjecting a golf ball 10 to abrasion. The inside surface 34 can include an abrasive material by, for example, having the abrasive material, such as sand paper 39, coated on the inside surface 34. The inside volume can include an abrasive material by, for example, containing an amount of loose aggregate of abrasive particulate, such as an amount of sand or an amount of sand and water, within the inside volume. The ball 10 can be subjected to abrasion by, for example, placing a ball 10 inside the drum 32 and turning the drum 32 to cause the ball 10 to contact the abrasive material 39. Turning the drum 32 at greater speeds can cause the ball 10 to tumble against the abrasive material with greater force by bouncing and rolling against the abrasive material and can thereby incur increased number and depth of deviations in the exterior surface in less time. The interactions with the abrasive material 39 also may be increased by providing vanes or other structures on the inside surface 34. The terms "rolling or rolled," "tumbling or tumbled," and "bouncing or bounced" as used herein in the context of a golf ball contacting an abrasive material are used synonymously.

The number and depth of deviations introduced to the exterior surface of the golf ball by using a rotable tumbler 30 can depend on, for example and among other variables, rotations per minute of the drum, the amount of time the ball is tumbled within the drum, the physical properties of the abrasive material, the construction specifications of the golf ball, and the construction specifications of the drum 32. In one embodiment, the rotable tumbler is provided with a plurality of correlations between at least one performance parameter and micro surface roughness for at least one type of golf ball. The at least one performance parameter can include, for example, aerodynamic properties of golf balls disclosed herein, such as spin, height, carry, coefficient of lift, coefficient of drag, and ratio of coefficient of lift to coefficient of drag. The correlations can further include correlations between rotations per minute of the tumbler, tumbling time, and resulting micro surface roughness for the at least one type of golf ball. The correlations can include other variables, such as those described throughout this disclosure. The correlations can allow the user to identify, for example, a desired performance parameter, such as increased carry, the amount of micro surface roughness needed for the ball to exhibit such parameter, and determine what rate of rotation and tumbling time for the rotable tumbler 30 will impart such amount of micro surface roughness to the ball 10. Such correlations for a specific tumbler and ball construction can be determined, for example, empirically.

Figure 16C:
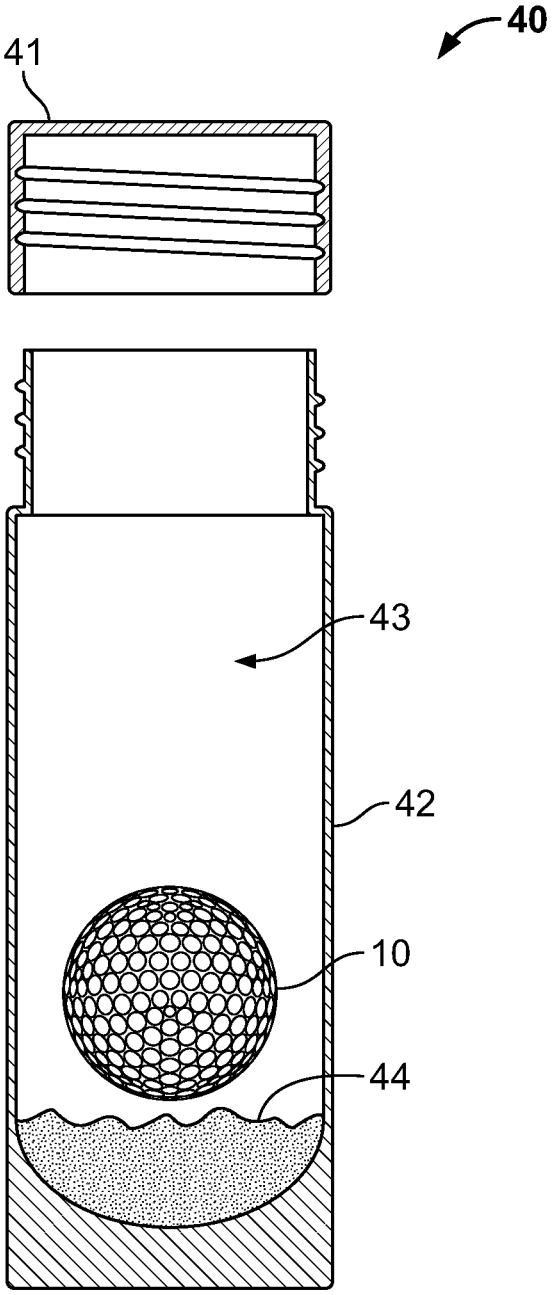

Referring to FIG. 16C, in an embodiment, the golf ball roughener is a container 40 with a lid 41. The container 40 can have a body 42 defining an inside volume 43. Securement of the lid 41 on the body 42 can seal contents within the container 40. An abrasive material such as an amount of loose aggregate of abrasive particulate 44, including sand or a mixture of sand and water, can be contained within the container 40. Additionally or alternatively, if desired, one or more walls of the container 40 and/or the interior of the cover 41 may be made roughened and/or include exposed abrasive material. The container 40 can be rotated or shaken to abrade the ball 10 with the abrasive particulate 44. The container 40 can be rotated in multiple ways, such as around a center axis, a horizontal axis, or both. As with the rotable tumbler described above, the amount of deviations introduced to the exterior surface of the golf ball 10 by using the container 40 to increase the micro surface roughness of the ball 10 can depend on, for example and among other variables, rotations per minute, the amount time the ball is subject to abrasion within the container, the physical properties of the abrasive material, and the construction specifications of the golf ball. In one embodiment, the container 40 is provided with a plurality of correlations between these variables and other variables, such as those described throughout this disclosure and, for example, the example variables identified above for the rotary tumbler.

Figure 16D:
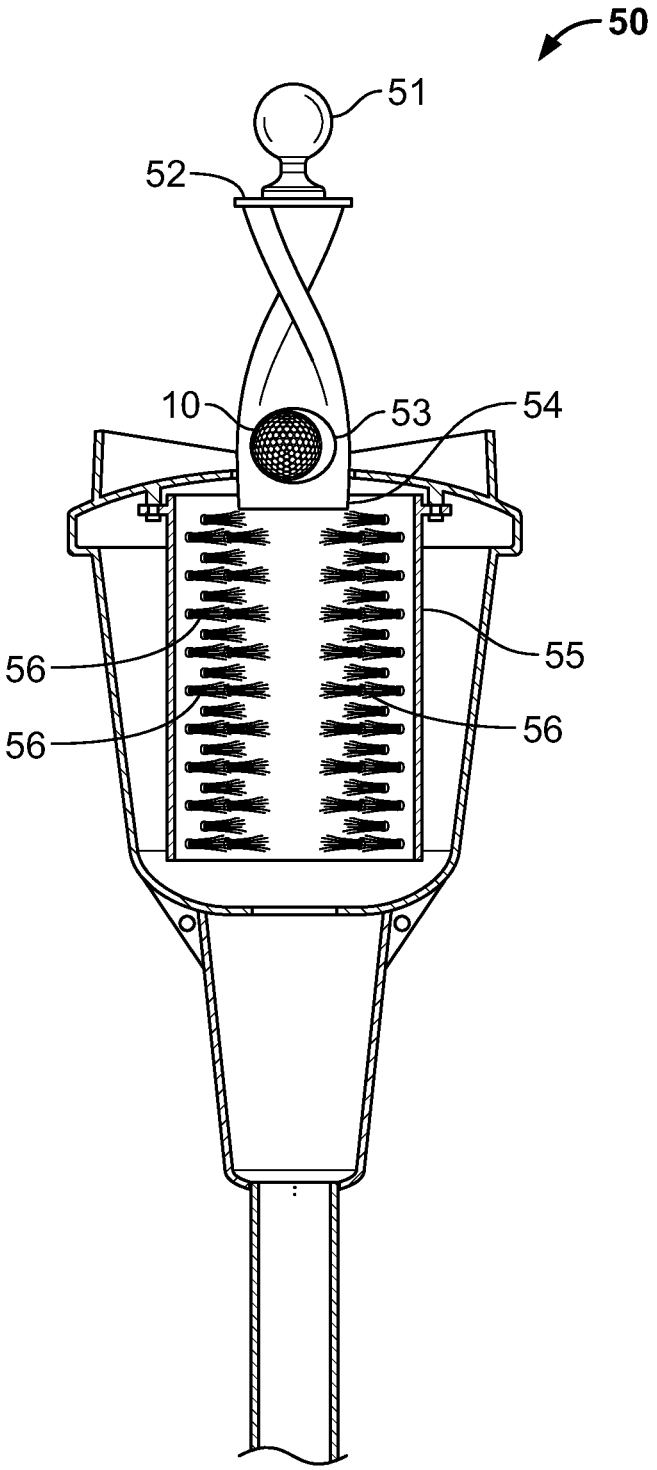

Referring to FIG. 16D, in an embodiment, the golf ball roughener utilizes a plunger 50 for rubbing a golf ball 10 against abrasive material. The plunger 50 can include a first end 52 and a distal end 54 opposite the first end. The plunger 50 can include a handle 51 proximate the first end 52 and a golf ball holder 53 in between the first end 52 and the distal end 54. The holder 53 can be a hole defined in the plunger. The holder 53 can be dimensioned to accommodate and hold a golf ball 10 such that the ball can rotate within the holder 53. The plunger 50 can further include a housing 55 containing abrasive material 56. The abrasive material of this example structure can be abrasive bristles 56. The abrasive bristles can be positioned in the housing 55 such that a golf ball 10 positioned in the holder 53 contacts the abrasive bristles 56 when the distal end 54 of the plunger is inserted into the housing 50. Inserting the plunger into and drawing the plunger out of the housing can subject the ball 10 to abrasion by the abrasive bristles 56 and thereby impart deviations into the exterior surface of the golf ball 10.

As with the example golf ball rougheners described above, the amount of deviations introduced to the exterior surface of the golf ball 10 by using the plunger and abrasive bristles can depend on, for example and among other variables, the number of times the ball is rubbed against the bristles, the physical properties of the abrasive material, and the construction specifications of the golf ball. In one embodiment, the plunger is provided with a plurality of correlations between these variables and other variables, such as those described throughout this disclosure and, for example, the example variables identified above for the rotary tumbler and the container. In addition to structure in which the ball 10 is contacted by bristles arranged in a substantially linear orientation (and the ball is moved in a substantially linear manner) as shown in FIG. 16D, the bristles may be arranged in a circular path and the ball may be moved around this circular path by a rotary motion, akin to the structure and arrangement of certain types of golf ball washer structures.

In an embodiment, heat can be applied to the golf ball during roughening to increase the susceptibility of the exterior surface to incurring deviations by abrasion. In an embodiment, a heat source can be included with a golf ball roughener. The correlations mentioned above also may include information regarding heating of the ball and/or the abrading chamber in which the ball is placed.

In an embodiment, a home appliance dryer can be used as a golf ball roughener. For example, the inside surface of the drum of the dryer can be lined with an abrasive material. Such an abrasive material can be, for example, an abrasive sheet having a first side including the abrasive material and a second side including an adhesive material. The abrasive sheet can be dimensioned to cover at least a portion of the vanes of the drum or at least a portion of the surface between the vanes of the drum. The amount of deviations introduced to the exterior surface of the golf ball by using a home appliance dryer can depend on, for example and among other variables, rotations per minute of the drum, the amount of time the ball is tumbled within the drum, the physical properties of the abrasive material, the construction specifications of the golf ball, and selected temperature of the drying cycle. In an embodiment, a plurality of correlations between these variables and other variable, such as those described throughout this disclosure and, for example, the example variables identified above for the rotary tumbler, can be provided. In one embodiment, a set of correlations can be provided between at least one performance parameter, micro surface roughness for at least one type of golf ball, and settings for the home appliance dryer with the abrasive material installed therein. In an embodiment, the correlations described above can be provided on a website on the Internet.

In an embodiment an instruction device includes one or more of the correlations mentioned above. The instruction device in various embodiments is an instruction sheet, a computer device (portable or stationary) including a memory storing the correlations, a website or a portion of a rotable tumbler that instructs a user to access a website.

Selective Micro Surface Roughening

In an embodiment, and as described above, increased micro surface roughness can be selectively applied to specific predetermined areas of the ball. The predetermined area can be less than a surface area of the entire exterior surface area of the ball. Surface area not included in the predetermined area can be referred to as the "remaining area," so that the "predetermined area" and the "remaining area" comprise the entire exterior surface area of the ball. Example predetermined areas can include an area covering at least one of two opposite poles of the golf ball, an area covering at least a portion of a seam of the golf ball, an area covering at least a portion of the lands between dimples of the golf ball, and an area covering at least a portion of one or more of the dimples. In an embodiment, the area covering at least a portion of one or more of the dimples can include the edges of one or more dimples. The micro surface roughness of the predetermined area can be selectively increased such that the micro surface roughness of the predetermined area is larger than the micro surface roughness of the remaining area. For example the predetermined area can have a micro surface roughness at least 1.20 times larger than the micro surface roughness of the remaining area. In one embodiment, the predetermined area covers 7.5% to 50% of the exterior surface area of the golf ball. In one embodiment, the predetermined area covers 50% to 75% of the exterior surface area of the golf ball.

Figure 17A:
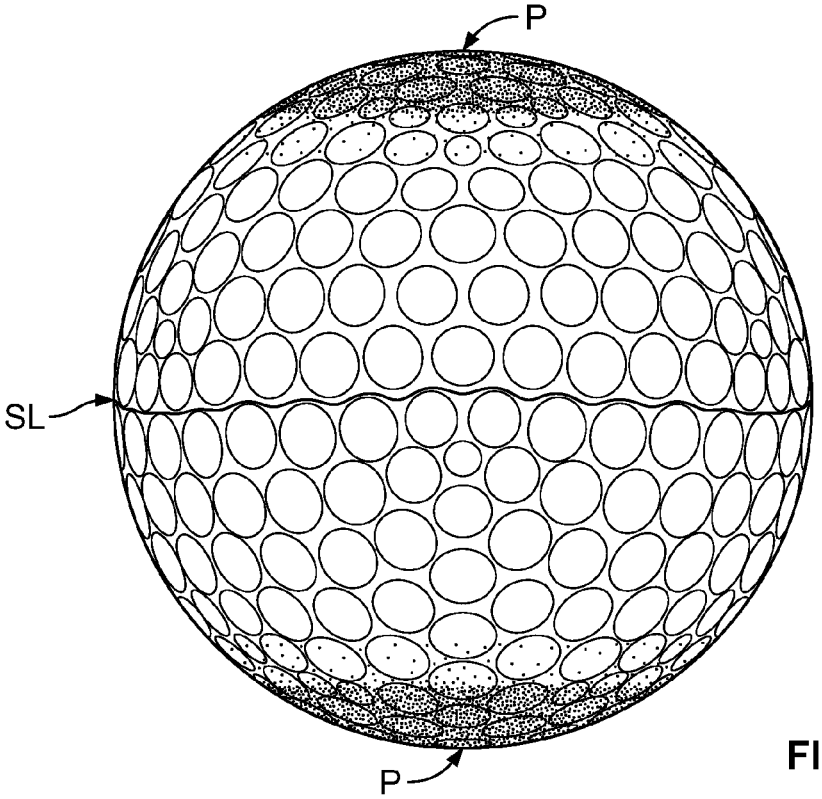
FIG. 17A through FIG. 17H depict embodiments of selective application of micro surface roughness to predetermined areas of a golf ball in accordance with examples of this disclosure.
Figure 17B:
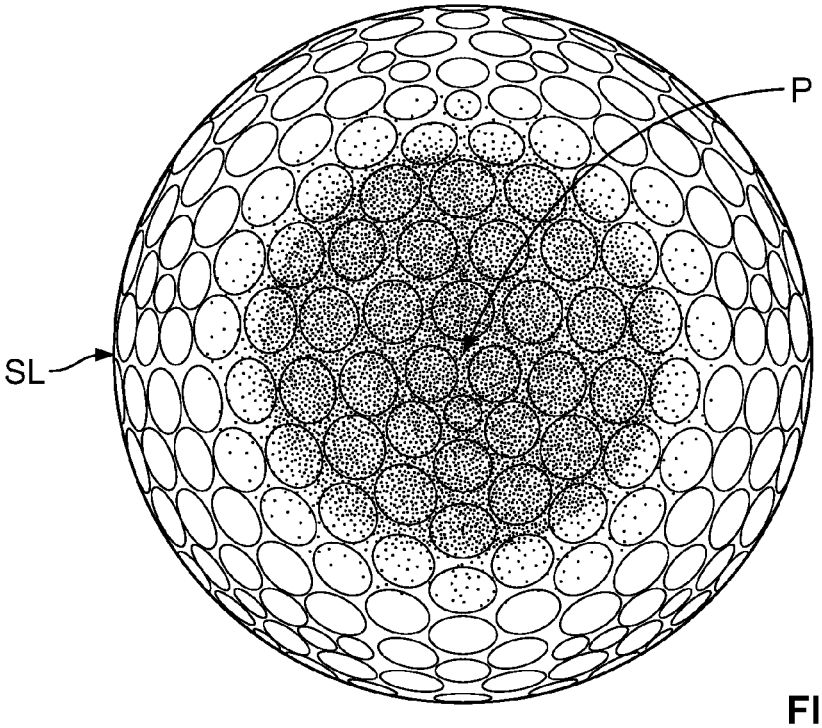
Figure 17C:
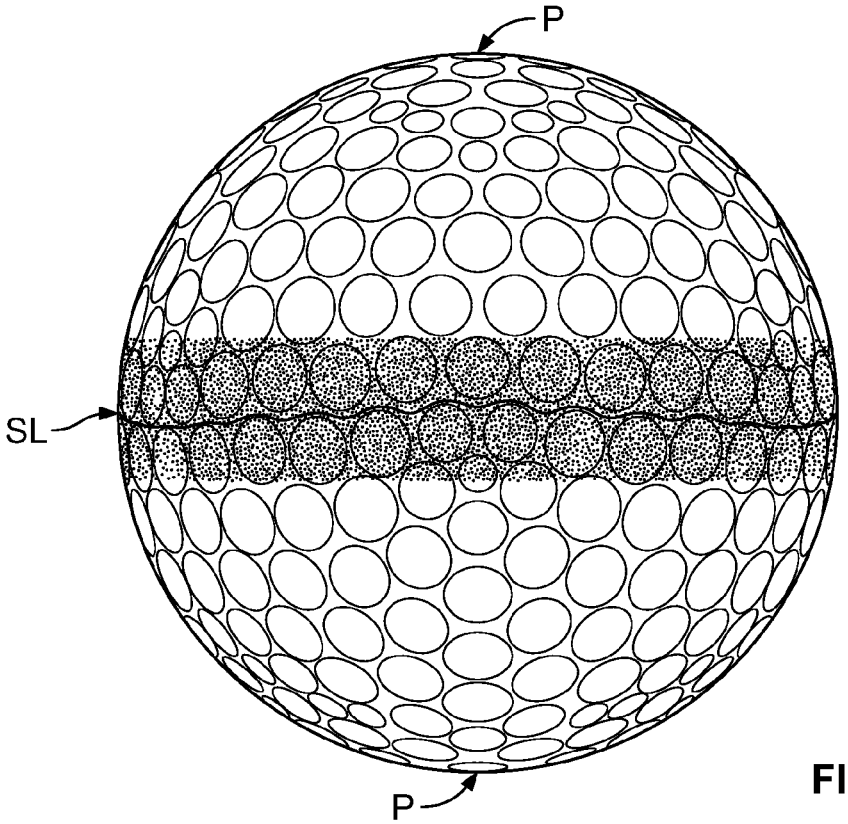
Figure 17D:
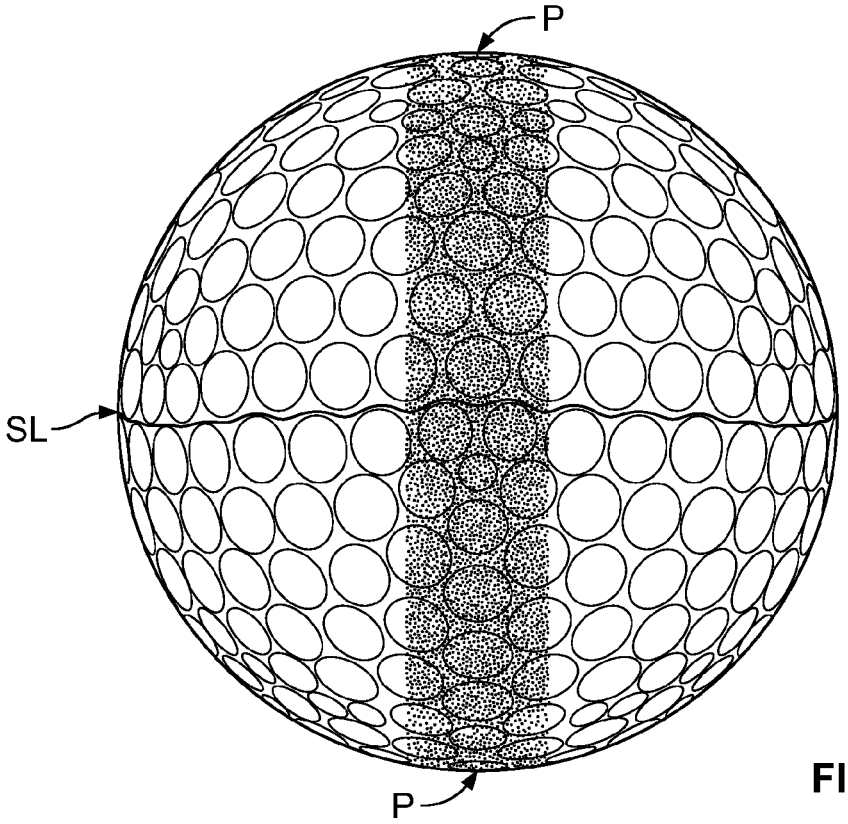
Figure 17E:
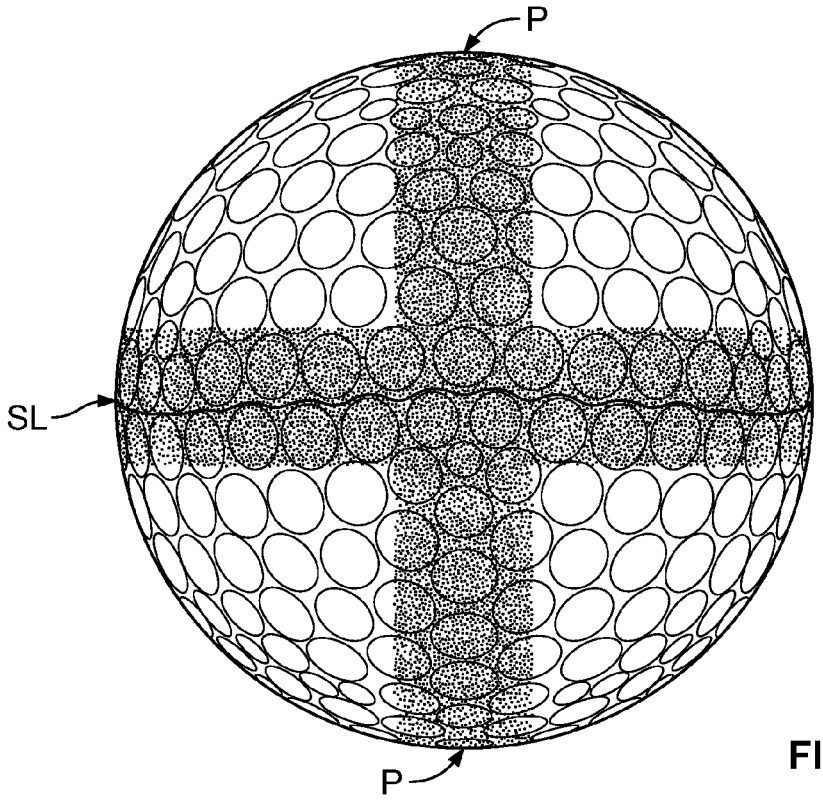
Figure 17F:
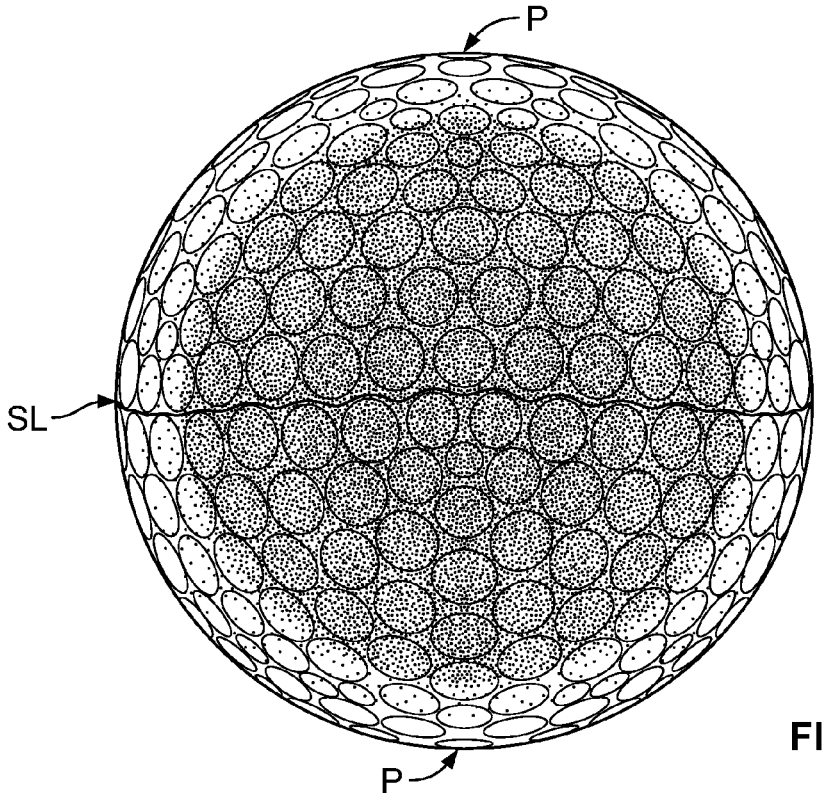
Figure 17G:
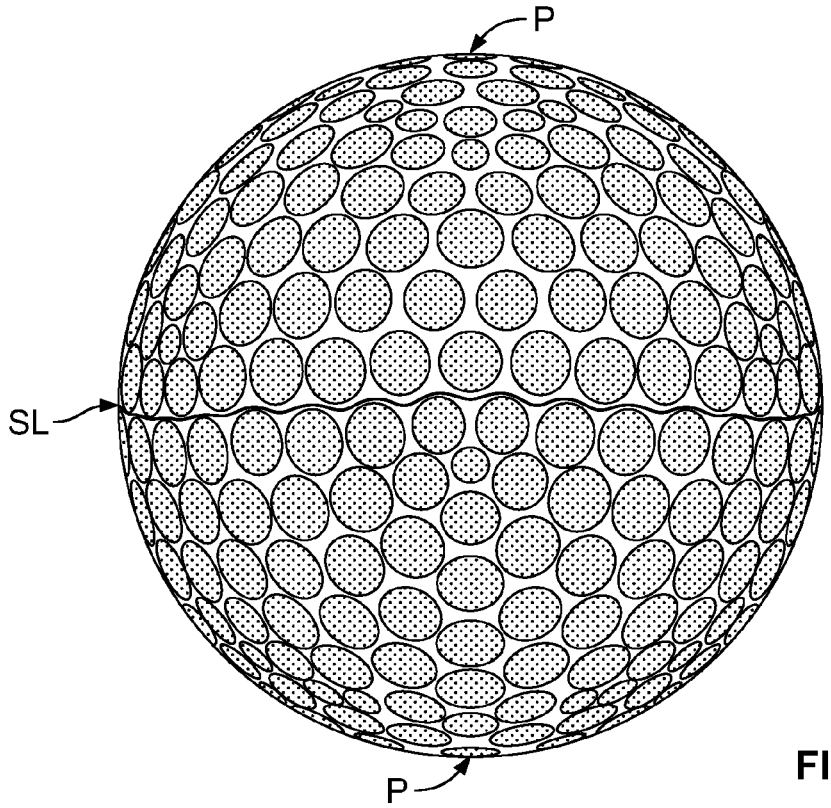
Figure 17H:
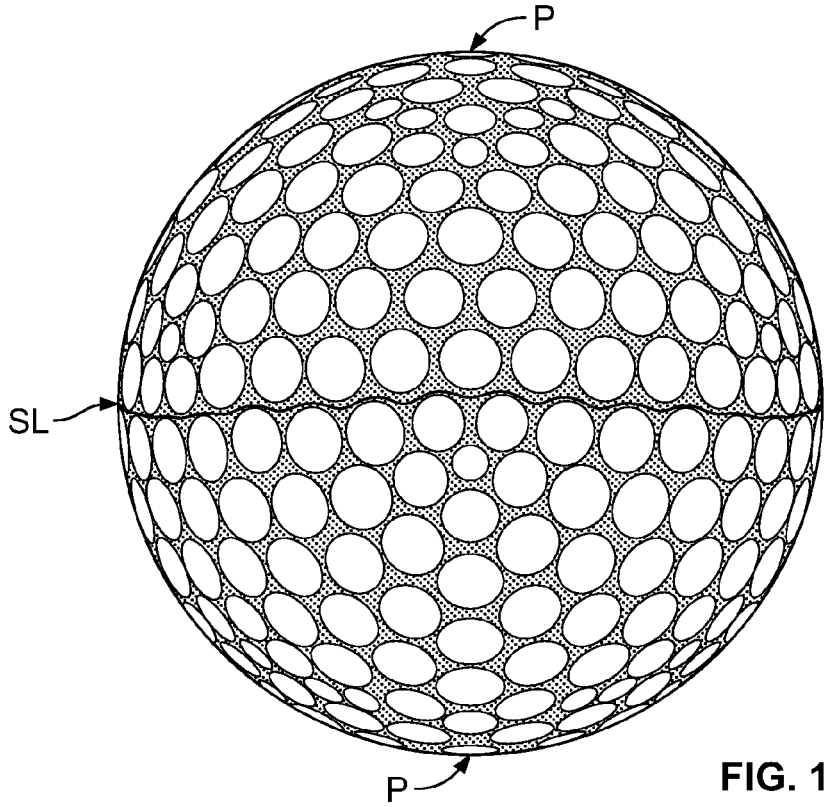

Referring to FIGS. 17A-17H, examples of predetermined areas of golf balls having micro surface roughness larger than that of the remaining areas are depicted. The opposing poles are identified with the letter "P," the seam line is identified with "SL," and the predetermined areas are identified with stipple shading. FIGS. 17A and 17B depict an example of a golf ball having a predetermined area covering two opposite poles of the golf ball, wherein the predetermined area covering each pole is in the pattern of a dome. FIG. 17C depicts an example of a golf ball having a predetermined area covering at least a portion of the seam line of the golf ball, wherein the predetermined area is in the pattern of a continuous band encircling the ball at the seam line (although the band could be discontinuous or include gaps within it, if desired). FIG. 17D depicts an example of a golf ball having a predetermined area covering a portion of the seam of the golf ball, wherein the predetermined area is in the form of a band encircling the ball in a position transverse to the seam line and around the poles of the ball. FIG. 17E depicts an example of a golf ball having a predetermined area covering two opposite poles and covering the seam of the golf ball, wherein the predetermined area is in the pattern of a first band encircling the ball at the seam line and a second band encircling the ball in a position transverse to the seam line and covering the poles. FIG. 17F depicts an example of golf ball having a predetermined area covering at least a portion of the seam of the golf ball, wherein the predetermined area is in the pattern of a dome covering a portion of the seam line (e.g., a dome centered on the seam line). FIG. 17G depicts an example of a golf ball having a predetermined area covering at least a portion of the interior surface one or more dimples. FIG. 17H depicts an example of a golf ball having a predetermined area covering at least a portion of lands between dimples of the golf ball. In one example, the land area between dimples can include the edges of the dimples.

In an embodiment, the predetermined area can be in the form of a symmetrical or asymmetrical pattern on the exterior surface of the golf ball. In the context of describing patterns of micro surface roughness, "symmetrical" as used herein means having correspondence in shape and relative position on opposite sides of the golf ball. For example, referring to FIGS. 17A and 17B, and where 17B depicts both the top view and bottom view of the ball of 17A, the dome patterns covering each pole are symmetrical in that the patterns cover an area of the same shape and are in the same relative position on opposite sides of the golf ball. For example, referring to FIG. 17F, where the dome pattern is included on one side of the ball alone, the pattern is asymmetrical.

Micro surface roughness can be selectively applied to predetermined areas of the golf ball according to several methods. In an embodiment, a coating comprising resin (with any additives) and surface roughening particles mixed therein can be selectively applied to the predetermined area golf ball body, e.g., by spraying the coating material onto the golf ball cover layer. In another embodiment, a resin layer (with any additives) is applied to the golf ball body and, prior to drying, the surface roughening particles can be selectively applied to the predetermined area on the top of the wet resin layer. In another embodiment, an ink that includes surface roughening particles mixed therein can be selectively applied to a predetermined area of a golf ball, such as a logo, player number, side stamp, geometric pattern or other indicia. The ink including surface roughening particles can be stamped on the cover of the golf ball or can be stamped over the coating of the golf ball. In another embodiment, the predetermined area can be roughened through mechanical abrasion, e.g., as described above in conjunction with FIGS. 16A through 16D (which can predominantly and selectively place the micro surface roughness in the land areas, as shown in FIG. 17H). In an embodiment, the predetermined areas shown in stipple shading in FIGS. 17A through 17H have micro surface roughness at least 1.2 times larger than the micro surface roughness in the remaining area (non-stippled area). In an embodiment, the predetermined areas shown in stipple shading in FIGS. 17A through 17H have micro surface roughness at least 1.2 times larger than a comparable ball having the same ball construction but without increased micro surface roughness (smooth ball).

In an embodiment, a stencil can be used to cover a portion of the exterior surface of the golf ball during roughening. The stencil can leave exposed the predetermined area for selective roughening and cover the remaining area to protect the remaining area from being roughened or being subject to further roughening. In other words, a stencil can "shadow" or "mask" areas of the ball on which increased micro surface roughening is not desired while allowing the exposed areas of the ball to be roughened.

Figure 18A:
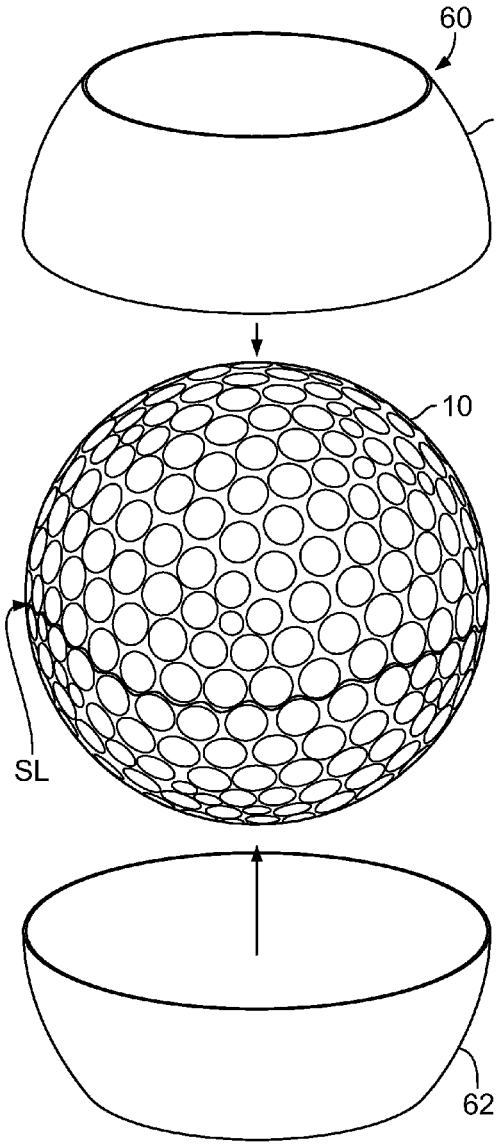
FIG. 18A through FIG. 18G depict embodiments of stencils for selective application of micro surface roughness to predetermined areas of a golf ball in accordance with examples of this disclosure.
Figure 18B:
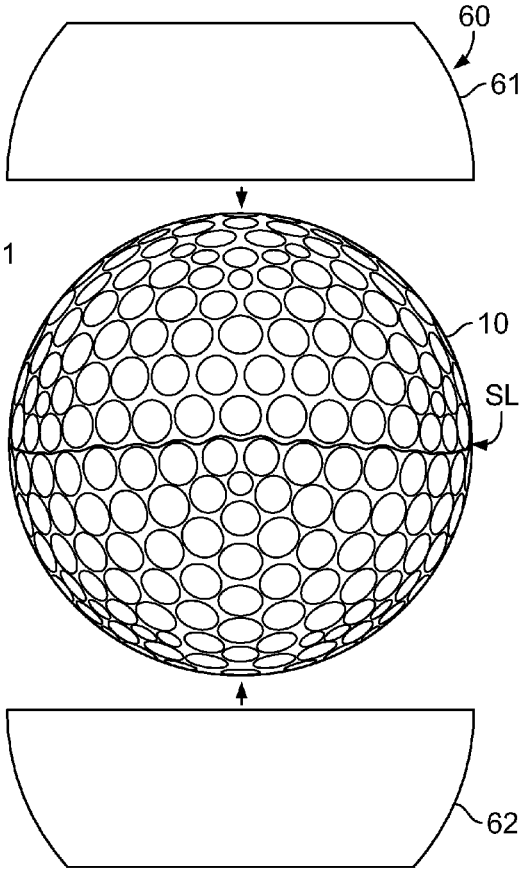
Figure 18C:
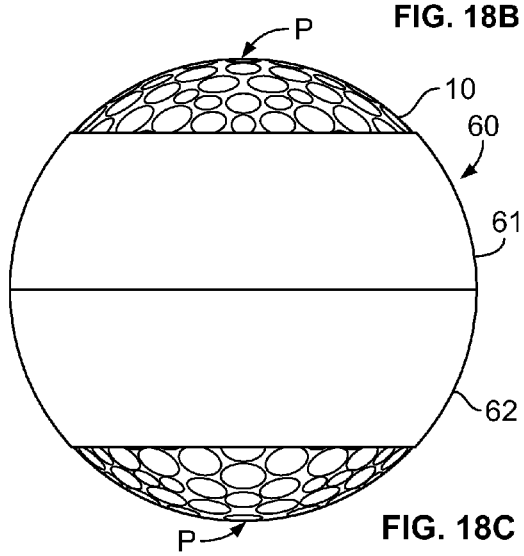

Referring to FIG. 18A to 18C, an example stencil 60 for defining a predetermined area on the exterior surface of golf ball in a pattern of symmetrical domes is shown. The stencil 60 can include a top portion 61 and a bottom portion 62, which when joined to contain the ball therein completes the stencil. The stencil can also be made of a single elastic piece that can be fitted over the ball 10. The stencil 60 covers the exterior surface of the golf ball except for the predetermined area such that the stencil leaves exposed the predetermined area to roughening and protects the covered area from roughening. In the example shown in FIG. 18C, the stencil leaves exposed an area covering the two opposite poles in the pattern of symmetrical domes.

Figure 18D:
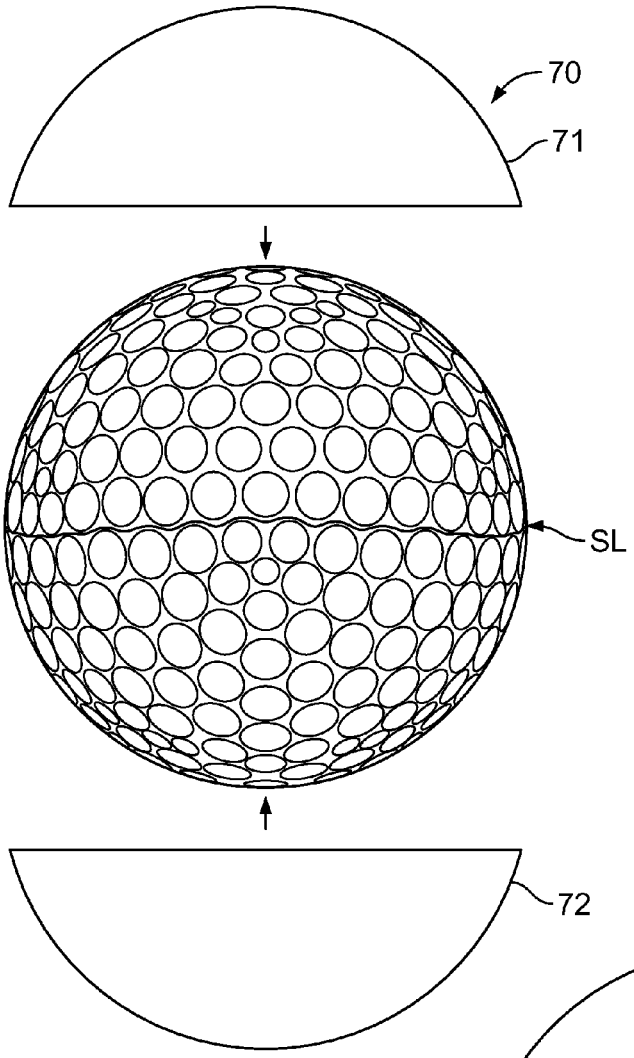
Figure 18E:
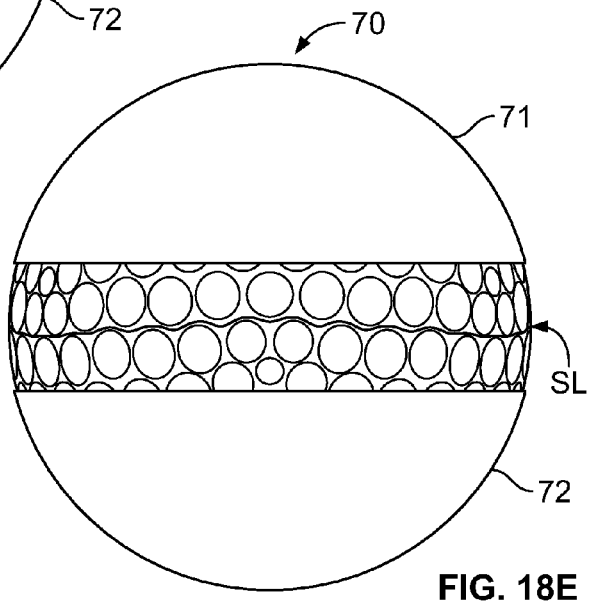

Referring to FIGS. 18D and 18E, an example stencil 70 for defining a predetermined area on the exterior surface of a golf ball 10 in a pattern of a band encircling the ball is shown. The stencil 70 can have a top portion 71 and a bottom portion 72 that when positioned on the ball in symmetrical fashion leave exposed the pattern of a band encircling the ball. In the example shown in FIG. 18E the stencil leaves exposed an area covering the seam of the golf ball.

Figure 18F:
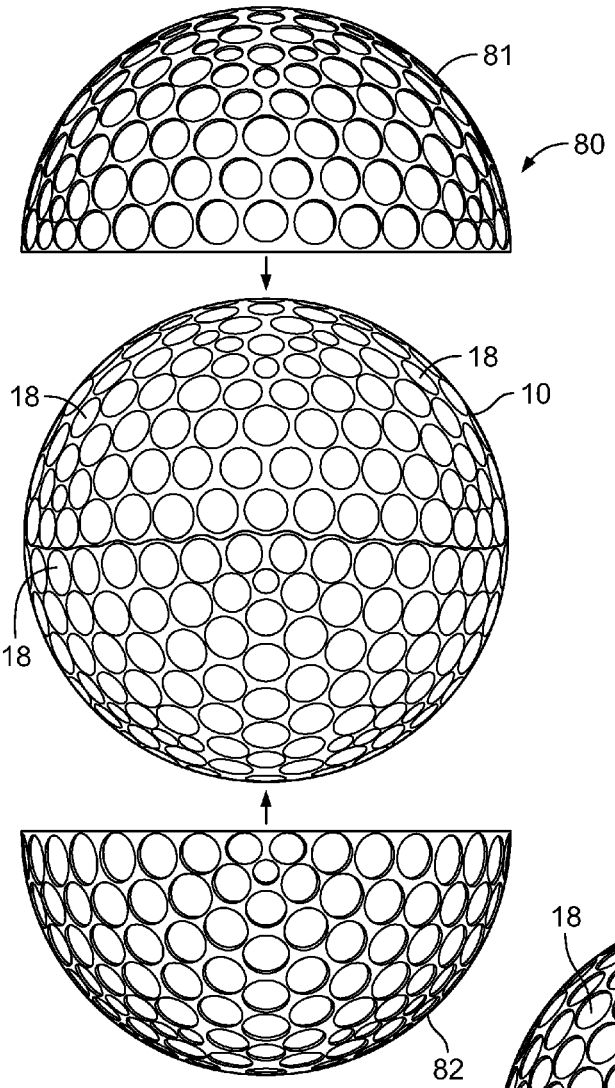
Figure 18G:
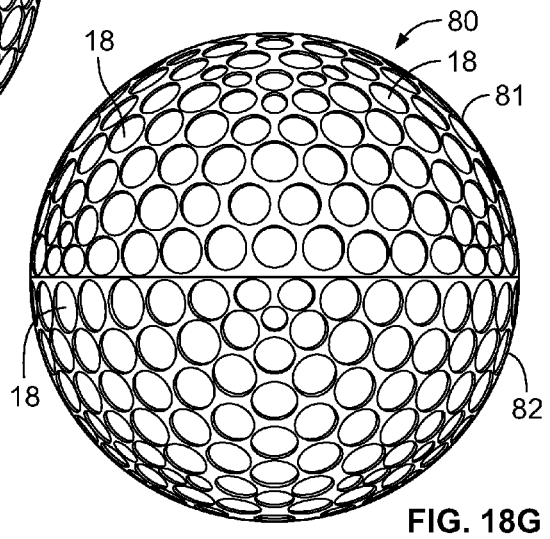

Referring to FIGS. 18F and 18G, an example stencil 80 for defining a predetermined area on the exterior surface of a golf ball 10 in a pattern of the dimples is shown. The stencil 80 can have a top portion 81 and a bottom portion 82 which include holes defined therein that can correspond to the pattern of the dimples 18 on the ball 10. In the example shown in FIG. 18G the stencil leaves exposed an area covering the dimples 18.

In one embodiment, an example stencil can define a predetermined area on the exterior surface of a golf ball 10 in a pattern of an area covering at least a portion of the lands between the dimples 18. The stencil can have a top portion and a bottom portion which include open areas defined therein in the form of areas covering the area of the lands between the dimples 18. The stencil can include covers for covering the area of the dimples 18. The open areas and covers of the stencil cooperate to leave exposed the area covering at least a portion of the lands between the dimples and cover the remaining area during roughening.

Optimized Micro Surface Roughening

In an embodiment, aspects of micro surface roughness can be optimized so that a ball having a specific set of specifications exhibits a particular enhanced aerodynamic property. Also, in an embodiment, aspects of micro surface roughness can be optimized so that a ball exhibits a particular enhanced aerodynamic property in accordance with a peak condition for such property as compared to comparative balls having different aspects of micro surface roughness. The term "aerodynamic property" and "performance parameter" can be used synonymously and include aerodynamic properties and performance parameters discussed above, such as spin, height, carry, coefficient of lift, coefficient of drag, and ratio of coefficient of lift to coefficient of drag. For example, aspects of micro surface roughness can be optimized so that a ball exhibits the longest carry as compared to comparative balls having the same ball construction but different aspects of micro surface roughness. In addition, for example, aspects of micro surface roughness can be optimized so that a ball exhibits an increased coefficient of lift throughout its trajectory as compared to comparative balls having the same ball construction but different aspects of micro surface roughness. In addition, for example, aspects of micro surface roughness can be optimized so that a ball exhibits an increased post-apex coefficient of drag during decent (which can also be referred to as post-apex coefficient of drag) as compared to comparative balls having the same ball construction but different aspects of micro surface roughness.

In an embodiment, aspects of micro surface roughness are varied in order to determine an optimized micro surface roughness so that the ball exhibits the enhanced aerodynamic property or enhanced aerodynamic property in accordance with a peak condition for such property as compared to comparative balls having different aspects of micro surface roughness. Variable aspects of micro surface roughness for applying a coating having resin and a plurality of surface roughening particles include aspects discussed herein and include as non-limiting examples, ball construction specifications, coating composition, coating composition formulation methods, coating application methods, coating devices, selective application of micro surface roughening on predetermined areas, surface roughening particle size, range of surface roughening particle size, surface roughening particle material, surface roughening particle concentration in the coating, level of micro surface roughness, and other aspects of micro surface roughness. Variable aspects of micro surface roughness for roughening the exterior surface of the ball with an abrasive material include aspects discussed herein and include as non-limiting examples, ball construction specifications, coating composition, coating composition formulation methods, coating application methods, coating devices, selective roughening of predetermined areas on the golf ball, golf ball roughener, methods of using the golf ball roughener, types of abrasive material, level of micro surface roughness, etc.

In an embodiment, aspects of micro surface roughness exhibit different enhanced aerodynamic properties or different degrees of enhanced aerodynamic properties according to different golf ball constructions specifications. For example, golf balls having the same aspects of enhanced micro surface roughness and the same construction specifications except for, for example, dimple pattern may exhibit different degrees of enhanced aerodynamic properties. Accordingly, in an embodiment, micro surface roughness can be optimized for each ball of different construction specifications. In an embodiment, micro surface roughness can be optimized for balls having the same construction specifications except for dimple pattern.

In an embodiment where an increase in the value of the performance parameter reflects an enhanced performance parameter, a golf ball having optimized micro surface roughness exhibits a performance parameter that is at least 95% of a peak performance parameter The peak performance parameter can be determined from, for example, the largest increase in the value of the performance parameter exhibited by: a first comparative ball without enhanced micro surface roughness (smooth ball), a second comparative ball of the same type as the smooth ball having micro surface roughness of about 2.0 times larger than the micro surface roughness of the smooth ball, a third comparative ball of the same type as the smooth ball having micro surface roughness of about 3.0 times larger than the micro surface roughness of the smooth ball, and a fourth comparative ball of the same type as the smooth ball having micro surface roughness of about 4.0 times larger than the micro surface roughness of the smooth ball. In an embodiment where a decrease in the value of the performance parameter reflects an enhanced performance parameter, the peak performance parameter can be determined from, for example, the largest decrease in the value of the performance parameter exhibited by the first, second, third, and fourth comparative balls as described above. The percentage increase or decrease in which a ball having optimized surface roughness exhibits in comparison to a comparative ball of the same type without enhanced micro surface roughness (smooth ball) can vary according to a particular ball construction specifications and/or the particular performance parameter. Similarly the percentage of the peak performance exhibited by a ball having optimized surface roughness can vary according to a particular ball construction specifications and/or the particular performance parameter.

Examples for Micro Surface Roughening of NIKE® 20XI-X Golf Balls

Golf balls of the same type were prepared in accordance with variable aspects of micro surface roughness as disclosed herein. As discussed above, golf balls of the same type have the same ball construction, including same dimple pattern. The aerodynamic performance of the golf balls were tested using an indoor test range ("ITR") corresponding to that used by the USGA for testing golf ball for conformance with USGA rules.

The type of golf ball used was the NIKE® 20XI-X ("20XI"). The 20XI is a four piece construction ball with a resin core. The 20XI includes a dimple pattern having 360 dimples prepared in accordance with aspects of U.S. patent application Ser. No. 13/184,254 filed Aug. 20, 2010, which is entirely incorporated herein by reference. A regular commercially available 20XI ball was used as the control ball and referred to in this example as "Control."

Examples and Test Results

Five 20XI balls were prepared in accordance with aspects of roughening the exterior surface of the ball with an abrasive material. Balls R, S, Q, and T were placed in a jar with 2⅔ cups sand and 2⅔ cups water and tumbled for 1, 2, 3, and 4 hours respectively. The type of sand used to prepare R, S, Q, and T was Fujilunduma available from Fuji Manufacturing Company Limited, Fujioka JP. Ball U was placed in a jar with sand and water and tumbled for 4 hours. The type of sand used to prepare U was QUIK, All-Purpose Sand #1152, QUIKRETE, Atlanta, Ga. Roughening performed by tumbling the balls in a mixture of sand and water as described above was found to impart deviations predominately at the lands and edges of the dimples without altering the interior surface of the dimples significantly. Accordingly, values of micro surface roughness based on measurements taken in the dimples of balls roughened by mixing in sand and water may not reflect the extent of micro surface roughness imparted on the edges of the dimple and lands of such golf ball.

Figure 19:
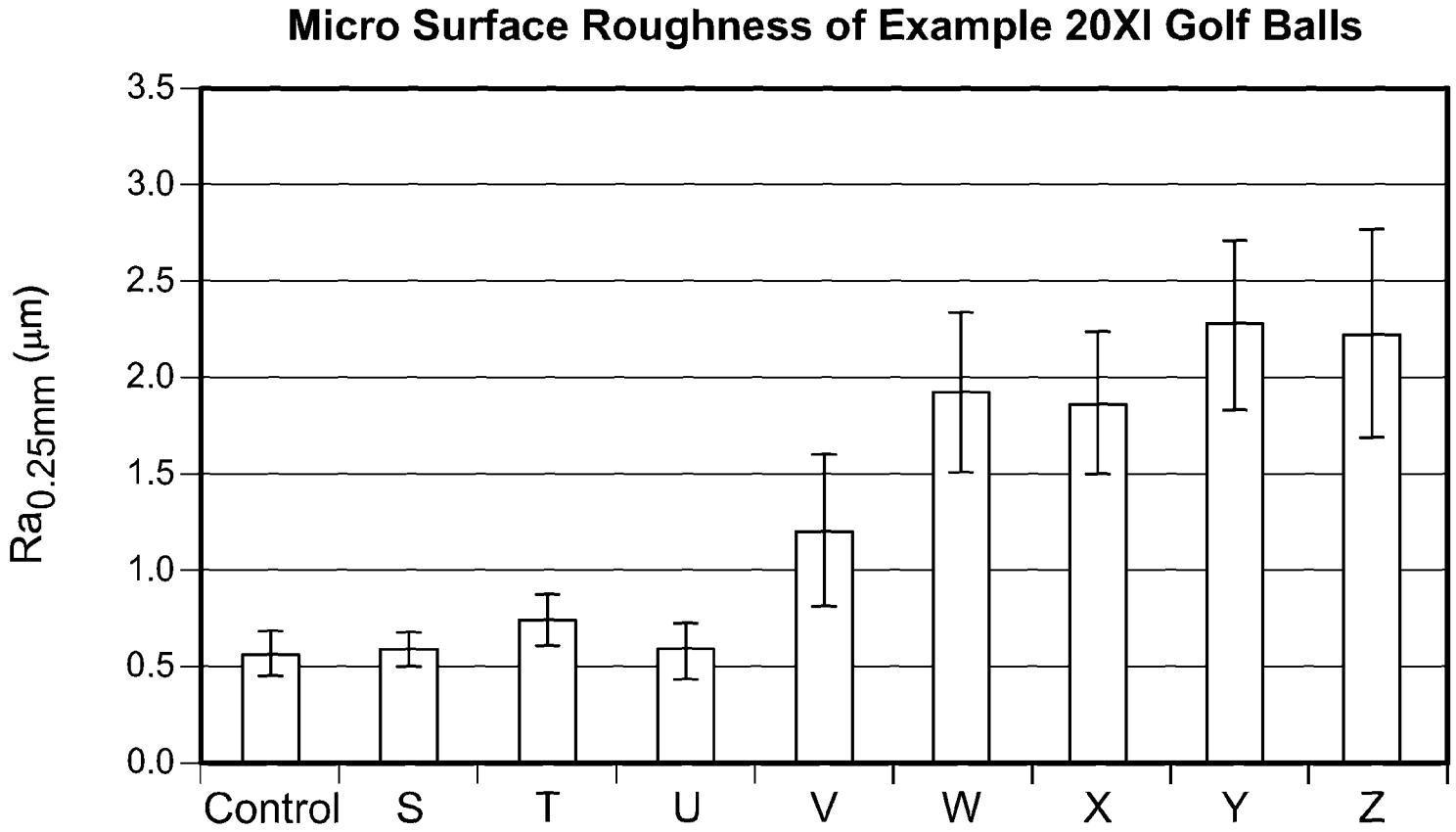
FIG. 19 is a graph illustrating levels of micro surface roughness for a control ball and roughened balls in accordance with examples in this disclosure.

FIG. 19 includes micro surface roughness ($Ra_{0.25mm}$) measurements for balls S, T, and U. The micro surface roughness values for balls in FIG. 19 were derived from measurements taken in various dimples dispersed around the surface of each ball. Accordingly, the micro surface roughness values of balls S, T, and U shown in FIG. 19 may not reflect the extent of micro surface roughness imparted on the dimple edges and lands of each ball.

FIG. 20A provides ITR data showing differences in total carry and roll in yards in comparison to the control ball for balls R, S, Q, T, and U for three driver shot simulations with different launch conditions in pole and seam positions. Balls R and S showed increased carry and roll for all but one launch condition. Ball U showed increased carry and roll for all launch conditions.

Figure 20B:
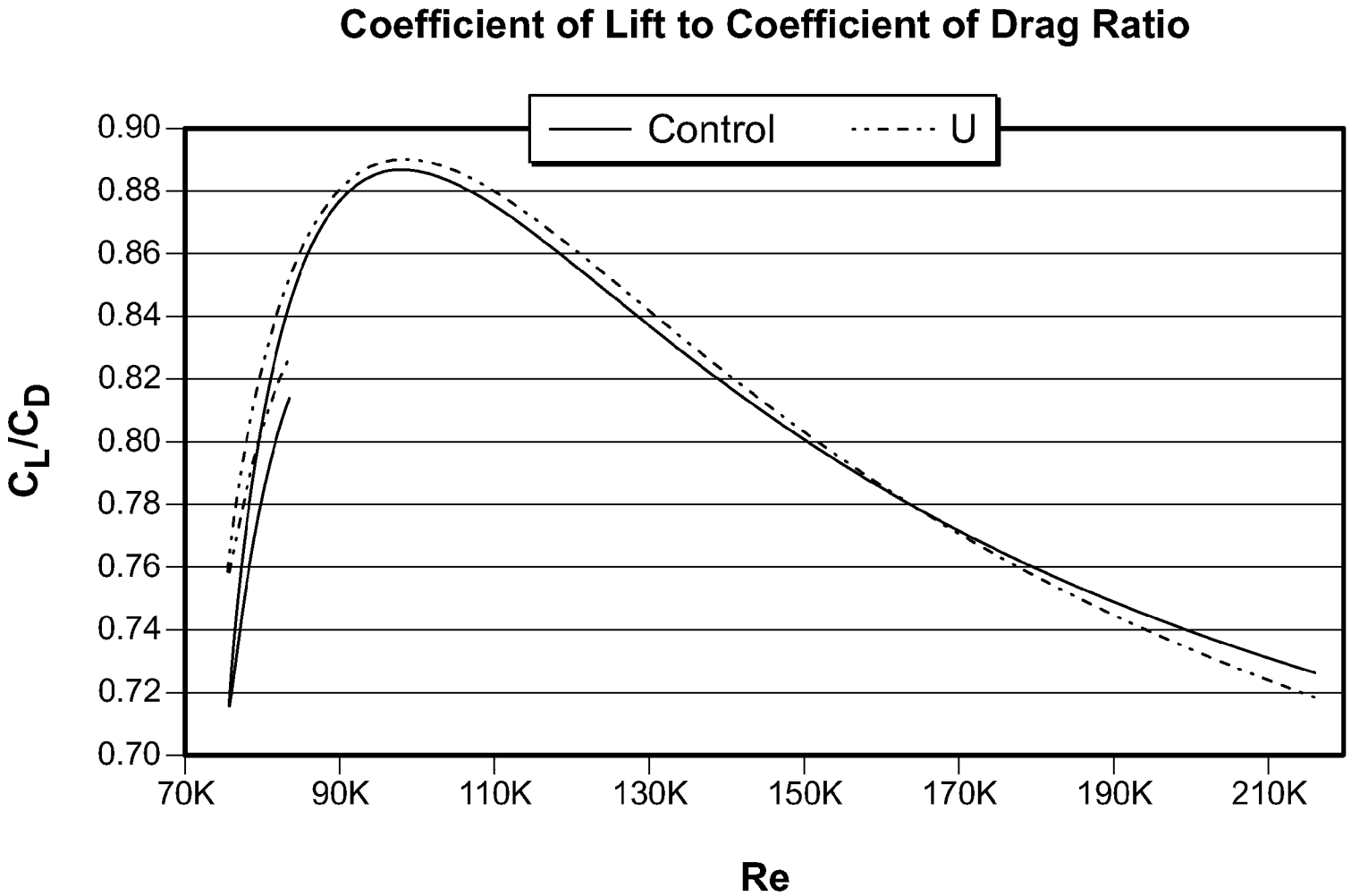
FIG. 20B is a graph illustrating coefficient of lift to coefficient of drag ratio for a roughened ball in accordance with examples of this disclosure and a smooth control ball at various Reynolds number and/or other launch conditions.

FIG. 20B is a graph showing the measured coefficient of lift to coefficient of drag ratio ($C_L/C_D$) over the tested range of Reynolds numbers using ITR testing for the Control ball and Ball U with the balls launched under a driver shot trajectory simulation with launch conditions of 258 ft/sec, 11°, and 33.3 revolutions/sec in pole position. Notably, roughened Ball U displayed a higher $C_L/C_D$ ratio throughout the post-apex phase of the tested range and parts of the pre-apex phase of the tested range, the apex being at about Re 85 k.

Figure 20C:
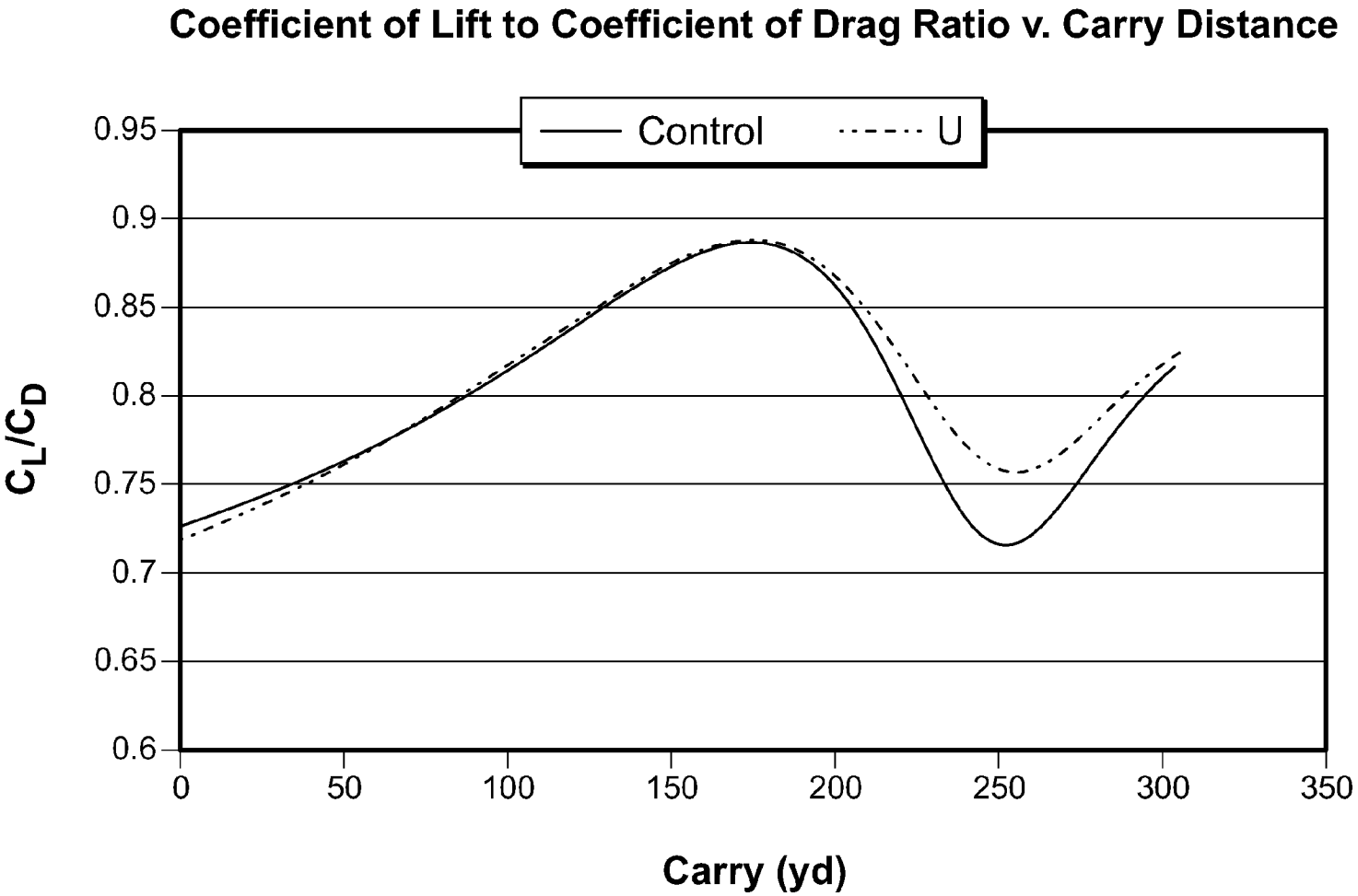
FIG. 20C is a graph illustrating coefficient of lift to coefficient of drag ratio v. carry for a roughened ball in accordance with examples of this disclosure and a smooth control ball.

FIG. 20C is a graph showing the measured $C_L/C_D$ ratio over carry in yards for the Control ball and Ball U with the balls launched under a driver shot trajectory simulation with launch conditions of 258 ft/sec, 11°, and 33.3 revolutions/sec in pole position. Again, roughened Ball U displayed a higher $C_L/C_D$ ratio throughout the post-apex phase of the range and parts of the pre-apex phase of the tested range, the apex being at about 170 yards.

Examples and Test Results

Five 20XI balls were prepared in accordance with variable aspects of applying a coating having resin and a plurality of surface roughening particles mixed therein to a golf ball body to produce coated golf balls. Balls V and W were coated with a clear coat resin having amorphous silica particles with particle size up to 5 μm. Balls X, Y, and Z were coated with a clear coat resin having 15 percent by weight crystalline silica particles with a particle size of up to 40 μm, 125 μm, and 160 μm, respectively. FIG. 19 includes micro surface roughness ($Ra_{0.25mm}$) measurements for balls V-Z. The micro surface roughness values for balls in FIG. 19 were derived from measurements taken in various dimples dispersed around the surface of each ball.

Figure 21B:
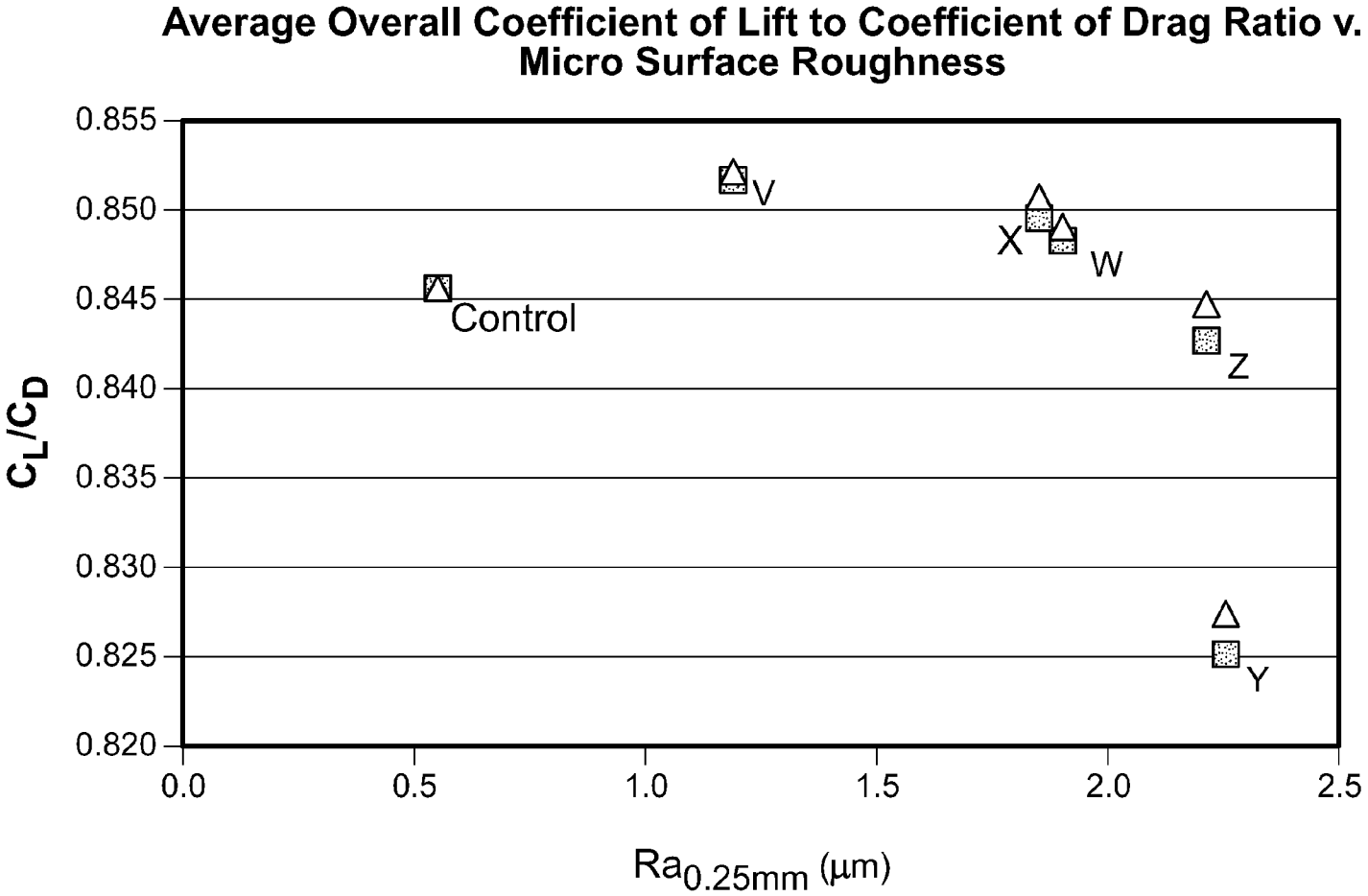
FIG. 21B through FIG. 21D are charts depicting data included in the table of FIG. 21A.
Figure 21C:
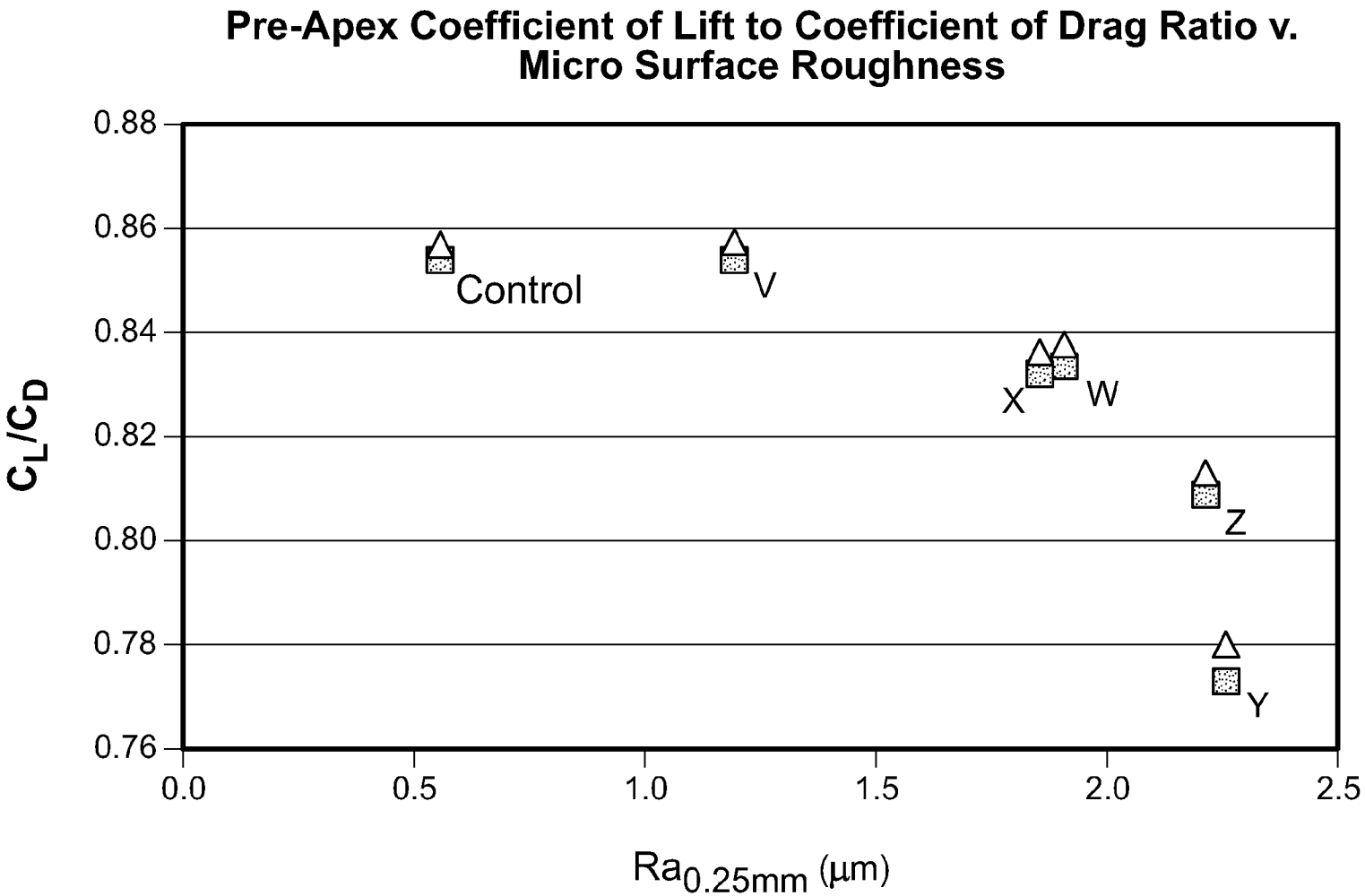
Figure 21D:
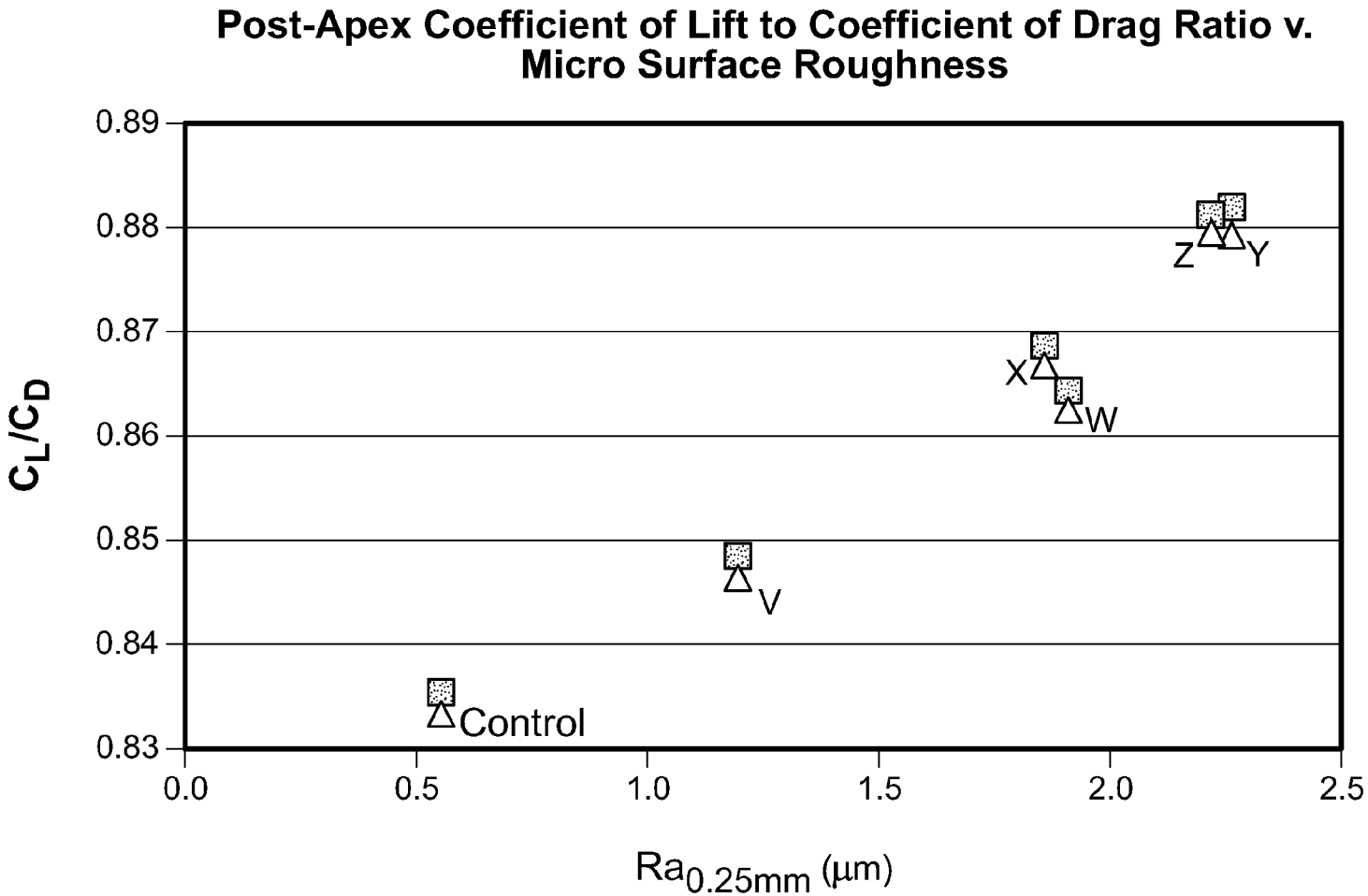

FIG. 21A is a table showing the measured pre-apex, post-apex, and overall average $C_L/C_D$ ratio for balls V, W, X, Y, and Z under driver shot trajectory simulation with launch conditions of 258 ft/sec, 9.7°, and 46 revolutions/sec (r/s) and 242 ft/sec, 11.3°, and 44.7 r/s in pole position. FIGS. 21B, 21C, and 21D plot in graphical form the $C_L/C_D$ ratios shown in the table of FIG. 21A according to the corresponding micro surface roughness values of the balls. The graph of FIG. 21B shows the overall average $C_L/C_D$ ratio versus micro surface roughness (Ra), the graph of FIG. 21C shows the pre-apex $C_L/C_D$ ratio versus Ra, and the graph of FIG. 21D shows the post-apex $C_L/C_D$ ratio versus Ra. Notably, balls V, W, and X exhibited increases in overall average $C_L/C_D$ ratios versus the control. Ball V has micro surface roughness about 2 times larger than the Control and balls W and X have micro surface roughness about 3 times larger than the Control. Ball V exhibited the largest increase in overall average $C_L/C_D$ ratio at 0.7% increase over the control. Balls Y and Z having micro surface roughness of about 4 times larger than the control exhibited decreases in overall average $C_L/C_D$ ratio versus the Control. Accordingly, at 0.7% larger than the Control, the overall average $C_L/C_D$ ratio of 0.852 for ball V is the peak value for the comparable balls tested.

Figure 21E:
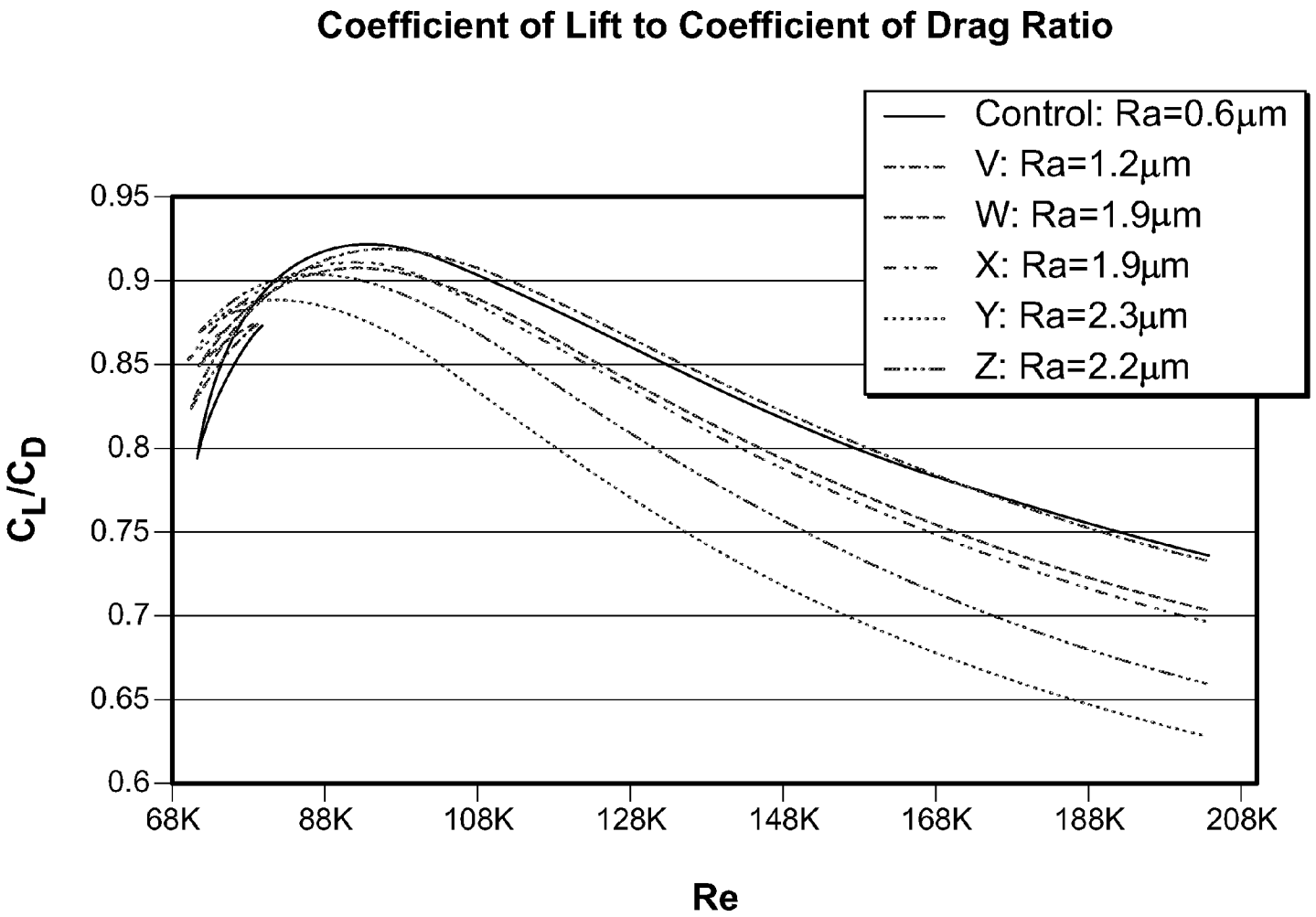
FIG. 21E and FIG. 21F are graphs illustrating coefficient of lift to coefficient of drag ratio for a roughened ball in accordance with examples of this disclosure and a smooth control ball at various Reynolds number and/or other launch conditions.
Figure 21F:
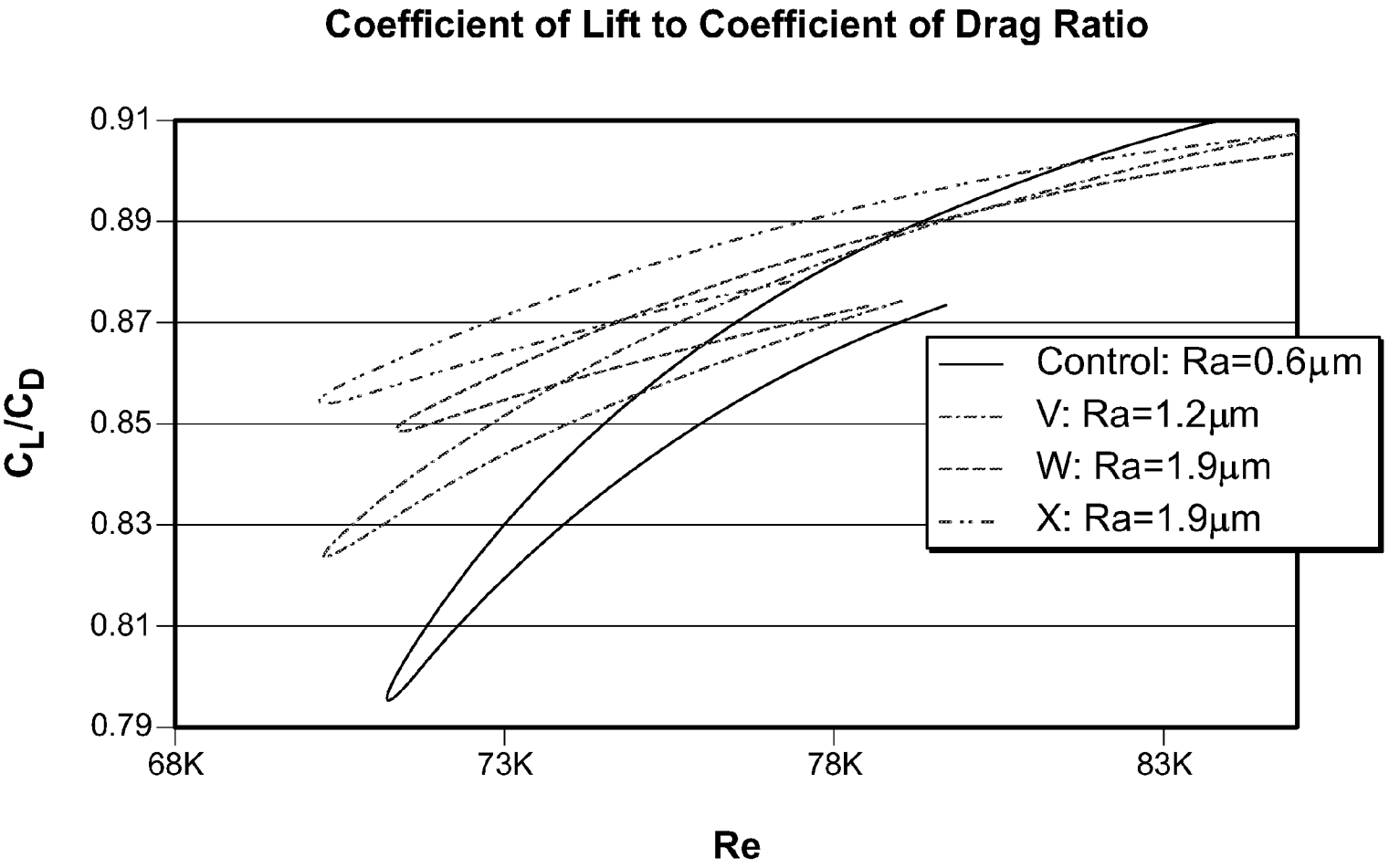

FIG. 21E is a graph showing the measured $C_L/C_D$ over the range of Reynolds numbers from ITR testing of balls V, W, X, Y, Z, and Control launched under a driver shot trajectory simulation with launch conditions of 258 ft/sec, 9.7°, and 46 r/s in pole position. FIG. 21F is a graph showing the post-apex phase of balls V, W, X, and Control of the test results shown in FIG. 21E.

The range of Reynolds number occurring during the driver shot trajectory of an average professional player is usually between 65 and 220 k. Reynolds numbers are proportional to the travelling velocity of the ball and therefore the highest Reynolds numbers occur right after club-ball impact. One can divide the trajectory into a pre-apex and a post-apex phase. While these two phases are time-wise usually approximately of equal length, their ranges of Reynolds numbers differ significantly.

Due to the complex nature of fluid dynamics in the boundary layer, subtle changes of the surface properties of the golf ball may alter aerodynamic parameters such as coefficient of drag and coefficient of lift significantly within a certain range of Reynolds number without having significant influence on other (higher or lower) ranges of Reynolds numbers. These subtle changes may be realized by adapting the surface on a micro scale (applying micro surface roughness of specific Ra).

Since certain changes in micro surface roughness seem to alter the aerodynamic parameters only within certain ranges of Reynolds number it is, at least in parts, possible to optimize aerodynamic parameters within certain sections of the trajectory without major changes in other ranges of Reynolds number. This might affect the carry, roll, total carry positively. Also the nature of the trajectory might be tailored to specific needs of certain golfers such as a higher or lower apex. Another possibility would be to alter the carry at apex. The influence of different launch conditions needs to be considered as well and might be another possibility to individualize trajectories for certain players. These considerations are consequently not only applicable to driver shots, but iron and wedge shots.

FIGS. 21G and 21H are tables showing additional ITR test results for balls V, W, X, Y, Z and Control for driver shot trajectory simulation with launch conditions of 242 ft/sec, 11.3°, and 44.7 r/s in pole position (FIG. 21G) and seam position (FIG. 21H). Notably, ball V exhibited the greatest increase over the control with 0.1% increase in apex, 0.7% increase angle, and 0.4% increase in time when shot in the pole position and 0.3% increase in carry and 0.5% increase in total yards when shot in the pole position. Ball Y exhibited the greatest increase over the control in roll with 19.9% increase in roll and 22.4% increase in roll for the pole and seam positions, respectively. Based on the example results for 20XI ball, in one embodiment, micro surface roughness value of 0.8-1.8 μm is beneficial for increasing driver shot carry and roll for the 20XI ball. In addition, a micro surface roughness value of 1.0-1.5 μm is beneficial for increasing total carry for the 20XI ball.

The golf ball body of the present invention has no limitation on its structure and includes a one-piece golf ball, a two-piece golf ball, a multi-piece golf ball comprising at least three layers, and a wound-core golf ball, including balls with different constructions, materials, and the like. Moreover, the present invention can be applied to any type of dimple pattern, including patterns with at least some non-round dimples (e.g., polygonal dimples, asymmetric dimples, dual radius dimples, etc.). The present invention can be applied for all types of the golf ball.

Conclusion

The present invention is described above and in the accompanying drawings with reference to a variety of example structures, features, elements, and combinations of structures, features, and elements. The purpose served by the disclosure, however, is to provide examples of the various features and concepts related to the invention, not to limit the scope of the invention. One skilled in the relevant art will recognize that numerous variations and modifications may be made to the embodiments described above without departing from the scope of the present invention, as defined by the appended claims. For example, the various features and concepts described above in conjunction with the figures may be used individually and/or in any combination or subcombination without departing from this invention.

We claim:

1. A method comprising:

providing a golf ball body having a core and a cover encasing the core;

applying a coating encasing the cover to form a golf ball having an exterior surface, wherein the coating includes a resin;

wherein the exterior surface has a predetermined area and a remaining area, wherein the predetermined area is smaller than a surface area of the entire exterior surface and wherein the predetermined area is in the form of an asymmetrical pattern on the exterior surface of the golf ball;

wherein surface roughening particles having an average size of 400 nm to 160 microns are present in the coating in a sufficient amount such that the predetermined area exhibits a micro surface roughness that is between about 1.2 μm and about 3.0 μm and the remaining area having micro surface roughness of less than or equal to about 1.0 μm, wherein micro surface roughness includes deviations from an ideal surface of 0.25 mm or less.

2. The method of claim 1 wherein the predetermined area covers 7.5 to 75% of the exterior surface.

3. The method of claim 1 wherein the surface roughening particles comprise 1 to 30% of a total weight of the coating in the predetermined area.

4. The method of claim 1 wherein the coating includes the surface roughening particles contained within the resin.

* * * * *